US008794543B2

(12) United States Patent
Leber

(10) Patent No.: US 8,794,543 B2
(45) Date of Patent: Aug. 5, 2014

(54) LOW-SPEED PULSATING SHOWERHEAD

(75) Inventor: Leland C. Leber, Fort Collins, CO (US)

(73) Assignee: Water Pik, Inc., Fort Collins, CO (US)

( * ) Notice: Subject to any disclaimer, the term of this patent is extended or adjusted under 35 U.S.C. 154(b) by 220 days.

(21) Appl. No.: 12/695,612

(22) Filed: Jan. 28, 2010

(65) Prior Publication Data

US 2010/0127096 A1 May 27, 2010

Related U.S. Application Data

(63) Continuation-in-part of application No. 11/964,670, filed on Dec. 26, 2007, now Pat. No. 8,366,024.

(60) Provisional application No. 60/882,441, filed on Dec. 28, 2006.

(51) Int. Cl.
*B05B 3/04* (2006.01)

(52) U.S. Cl.
USPC ..... 239/381; 239/558; 239/562

(58) Field of Classification Search
CPC ..... B05B 3/02; B05B 3/04; B05B 3/0413; B05B 3/0486; B05B 3/0422; B05B 3/04541; B05B 1/14; B05B 1/18; B05B 1/20
USPC ..... 239/214–214.23, 222.17–222.21, 239/237–242, 380–383, 482–484, 487, 488, 239/490–497, 556–564
See application file for complete search history.

(56) References Cited

U.S. PATENT DOCUMENTS

| | | | |
|---|---|---|---|
| 203,094 | A | 4/1878 | Wakeman |
| 204,333 | A | 5/1878 | Josias |
| 309,349 | A | 12/1884 | Hart |
| 428,023 | A | 5/1890 | Schoff |
| 432,712 | A | 7/1890 | Taylor |
| 445,250 | A | 1/1891 | Lawless |
| 453,109 | A | 5/1891 | Dreisorner |
| 486,986 | A | 11/1892 | Schinke |

(Continued)

FOREIGN PATENT DOCUMENTS

| | | |
|---|---|---|
| CA | 659510 | 3/1963 |
| CH | 234284 | 3/1963 |

(Continued)

OTHER PUBLICATIONS

Color Copy, Labeled 1A, Gemlo, available at least as early as Dec. 2, 1998.

(Continued)

*Primary Examiner* — Christopher Kim
(74) *Attorney, Agent, or Firm* — Dorsey & Whitney LLP

(57) ABSTRACT

A showerhead may include a housing, a turbine, and a shutter. The housing may include a fluid inlet, at least one fluid outlet, and a chamber in fluid communication with the inlet and one or more outlets. The turbine and shutter may be placed in the cavity. The shutter may include at least one opening. The shutter may selectively cover and uncover fluid outlets, thus selectively fluidly connecting the fluid outlets with the chamber. Water flowing through the housing causes the turbine to spin. As the turbine spins, the shutter rotates at a slower speed than the turbine to produce a periodic interruption of water flow through the outlets by covering and uncovering the outlets as the shutter rotates within the housing.

26 Claims, 17 Drawing Sheets

(56) References Cited

U.S. PATENT DOCUMENTS 566,384 A 8/1896 Engelhart
566,410 A 8/1896 Schinke
570,405 A 10/1896 Jerguson et al.
694,888 A 3/1902 Pfluger
800,802 A 10/1905 Franquist
832,523 A 10/1906 Andersson
835,678 A 11/1906 Hammond
845,540 A 2/1907 Ferguson
854,094 A 5/1907 Klein
926,929 A 7/1909 Dusseau
1,001,842 A 8/1911 Greenfield
1,003,037 A 9/1911 Crowe
1,018,143 A 2/1912 Vissering
1,046,573 A 12/1912 Ellis
1,130,520 A 3/1915 Kenney
1,203,466 A 10/1916 Benson
1,217,254 A 2/1917 Winslow
1,218,895 A 3/1917 Porter
1,255,577 A 2/1918 Berry
1,260,181 A 3/1918 Garnero
1,276,117 A 8/1918 Riebe
1,284,099 A 11/1918 Harris
1,327,428 A 1/1920 Gregory
1,451,800 A 4/1923 Agner
1,459,582 A 6/1923 Dubee
1,469,528 A 10/1923 Owens
1,500,921 A 7/1924 Bramson et al.
1,560,789 A 11/1925 Johnson et al.
1,597,477 A 8/1926 Panhorst
1,633,531 A 6/1927 Keller
1,692,394 A 11/1928 Sundh
1,695,263 A 12/1928 Jacques
1,724,147 A 8/1929 Russell
1,724,161 A 8/1929 Wuesthoff
1,736,160 A 11/1929 Jonsson
1,754,127 A 4/1930 Srulowitz
1,758,115 A 5/1930 Kelly
1,778,658 A 10/1930 Baker
1,821,274 A 9/1931 Plummer
1,849,517 A 3/1932 Fraser
1,890,156 A 12/1932 Konig
1,906,575 A 5/1933 Goeriz
1,934,553 A 11/1933 Mueller et al.
1,946,207 A 2/1934 Haire
2,011,446 A 8/1935 Judell
2,024,930 A 12/1935 Judell
2,033,467 A 3/1936 Groeniger
2,044,445 A 6/1936 Price et al.
2,085,854 A 7/1937 Hathaway et al.
2,096,912 A 10/1937 Morris
2,117,152 A 5/1938 Crosti
D113,439 S 2/1939 Reinecke
2,196,783 A 4/1940 Shook
2,197,667 A 4/1940 Shook
2,216,149 A 10/1940 Weiss
D126,433 S 4/1941 Enthof
2,251,192 A 7/1941 Krumsiek et al.
2,268,263 A 12/1941 Newell et al.
2,285,831 A 6/1942 Pennypacker
2,342,757 A 2/1944 Roser
2,402,741 A 6/1946 Draviner
D147,258 S 8/1947 Becker
D152,584 S 2/1949 Becker
2,467,954 A 4/1949 Becker
2,546,348 A 3/1951 Schuman
2,567,642 A 9/1951 Penshaw
2,581,129 A 1/1952 Muldoon
D166,073 S 3/1952 Dunkelberger
2,648,762 A 8/1953 Dunkelberger
2,664,271 A 12/1953 Arutunoff
2,671,693 A 3/1954 Hyser et al.
2,676,806 A 4/1954 Bachman
2,679,575 A 5/1954 Haberstump
2,680,358 A 6/1954 Zublin
2,726,120 A 12/1955 Bletcher et al.
2,759,765 A 8/1956 Pawley
2,776,168 A 1/1957 Schweda
2,792,847 A 5/1957 Spencer
2,873,999 A 2/1959 Webb
2,930,505 A 3/1960 Meyer
2,931,672 A 4/1960 Merritt et al.
2,935,265 A 5/1960 Richter
2,949,242 A 8/1960 Blumberg et al.
2,957,587 A 10/1960 Tobin
2,966,311 A 12/1960 Davis
D190,295 S 5/1961 Becker
2,992,437 A 7/1961 Nelson et al.
3,007,648 A 11/1961 Fraser
D192,935 S 5/1962 Becker
3,032,357 A 5/1962 Shames et al.
3,034,809 A 5/1962 Greenberg
3,037,799 A 6/1962 Mulac
3,081,339 A 3/1963 Green et al.
3,092,333 A 6/1963 Gaiotto
3,098,508 A 7/1963 Gerdes
3,103,723 A 9/1963 Becker
3,104,815 A 9/1963 Schultz
3,104,827 A 9/1963 Aghnides
3,111,277 A 11/1963 Grimsley
3,112,073 A 11/1963 Larson et al.
3,143,857 A 8/1964 Eaton
3,196,463 A 7/1965 Farneth
3,231,200 A 1/1966 Heald
3,236,545 A 2/1966 Parkes et al.
3,239,152 A 3/1966 Bachli et al.
3,266,059 A 8/1966 Stelle
3,272,437 A 9/1966 Coson
3,273,359 A 9/1966 Fregeolle
3,306,634 A 2/1967 Groves et al.
3,323,148 A 6/1967 Burnon
3,329,967 A 7/1967 Martinez et al.
3,341,132 A 9/1967 Parkison
3,342,419 A 9/1967 Weese
3,344,994 A 10/1967 Fife
3,363,842 A 1/1968 Burns
3,383,051 A 5/1968 Fiorentino
3,389,925 A 6/1968 Gottschald
3,393,311 A 7/1968 Dahl
3,393,312 A 7/1968 Dahl
3,404,410 A 10/1968 Sumida
3,492,029 A 1/1970 French et al.
3,516,611 A 6/1970 Piggott
3,546,961 A 12/1970 Marton
3,550,863 A 12/1970 McDermott
3,552,436 A 1/1971 Stewart
3,565,116 A 2/1971 Gabin
3,566,917 A 3/1971 White
3,580,513 A 5/1971 Martin
3,584,822 A 6/1971 Oram
3,596,835 A 8/1971 Smith et al.
3,612,577 A 10/1971 Pope
3,637,143 A 1/1972 Shames et al.
3,641,333 A 2/1972 Gendron
3,647,144 A 3/1972 Parkison et al.
3,663,044 A 5/1972 Contreras et al.
3,669,470 A 6/1972 Deurloo
3,672,648 A 6/1972 Price
3,682,392 A 8/1972 Kint
3,685,745 A 8/1972 Peschcke-koedt
D224,834 S 9/1972 Laudell
3,711,029 A 1/1973 Bartlett
3,722,798 A 3/1973 Bletcher et al.
3,722,799 A 3/1973 Rauh
3,731,084 A 5/1973 Trevorrow
3,754,779 A 8/1973 Peress
D228,622 S 10/1973 Juhlin
3,762,648 A 10/1973 Deines et al.
3,768,735 A 10/1973 Ward
3,786,995 A 1/1974 Manoogian et al.
3,801,019 A 4/1974 Trenary et al.
3,810,580 A 5/1974 Rauh
3,826,454 A 7/1974 Zieger
3,840,734 A 10/1974 Oram
3,845,291 A 10/1974 Portyrata

(56) References Cited

U.S. PATENT DOCUMENTS 3,860,271 A 1/1975 Rodgers
3,861,719 A 1/1975 Hand
3,865,310 A 2/1975 Elkins et al.
3,869,151 A 3/1975 Fletcher et al.
3,896,845 A 7/1975 Parker
3,902,671 A 9/1975 Symmons
3,910,277 A 10/1975 Zimmer
D237,708 S 11/1975 Grohe
3,929,164 A 12/1975 Richter
3,929,287 A 12/1975 Givler et al.
3,958,756 A 5/1976 Trenary et al.
D240,322 S 6/1976 Staub
3,963,179 A 6/1976 Tomaro
3,967,783 A 7/1976 Halsted et al.
3,979,096 A 9/1976 Zieger
3,997,116 A 12/1976 Moen
3,998,390 A 12/1976 Peterson et al.
3,999,714 A 12/1976 Lang
4,005,880 A 2/1977 Anderson et al.
4,006,920 A 2/1977 Sadler et al.
4,023,782 A 5/1977 Eifer
4,042,984 A 8/1977 Butler
4,045,054 A 8/1977 Arnold
D245,858 S 9/1977 Grube
D245,860 S 9/1977 Grube
4,068,801 A 1/1978 Leutheuser
4,081,135 A 3/1978 Tomaro
4,084,271 A 4/1978 Ginsberg
4,091,998 A 5/1978 Peterson
D249,356 S 9/1978 Nagy
4,117,979 A 10/1978 Lagarelli et al.
4,129,257 A 12/1978 Eggert
4,130,120 A 12/1978 Kohler, Jr.
4,131,233 A 12/1978 Koenig
4,133,486 A 1/1979 Fanella
4,135,549 A 1/1979 Baker
D251,045 S 2/1979 Grube
4,141,502 A 2/1979 Grohe
4,151,955 A 5/1979 Stouffer
4,151,957 A 5/1979 Gecewicz et al.
4,162,801 A 7/1979 Kresky et al.
4,165,837 A 8/1979 Rundzaitis
4,167,196 A 9/1979 Morris
4,174,822 A 11/1979 Larsson
4,185,781 A 1/1980 O'Brien
4,190,207 A 2/1980 Fienhold et al.
4,191,332 A 3/1980 De Langis et al.
4,203,550 A 5/1980 On
4,209,132 A 6/1980 Kwan
D255,626 S 7/1980 Grube
4,219,160 A 8/1980 Allred, Jr.
4,221,338 A 9/1980 Shames et al.
4,239,409 A * 12/1980 Osrow ..... 401/281
4,243,253 A 1/1981 Rogers, Jr.
4,244,526 A 1/1981 Arth
D258,677 S 3/1981 Larsson
4,254,914 A 3/1981 Shames et al.
4,258,414 A 3/1981 Sokol
4,272,022 A 6/1981 Evans
4,274,400 A 6/1981 Baus
4,282,612 A 8/1981 King
D261,300 S 10/1981 Klose
D261,417 S 10/1981 Klose
4,303,201 A 12/1981 Elkins et al.
4,319,608 A 3/1982 Raikov et al.
4,330,089 A 5/1982 Finkbeiner
D266,212 S 9/1982 Haug et al.
4,350,298 A 9/1982 Tada
4,353,508 A 10/1982 Butterfield et al.
4,358,056 A 11/1982 Greenhut et al.
D267,582 S 1/1983 Mackay et al.
D268,359 S 3/1983 Klose
D268,442 S 3/1983 Darmon
D268,611 S 4/1983 Klose
4,383,554 A 5/1983 Merriman
4,396,797 A 8/1983 Sakuragi et al.
4,398,669 A 8/1983 Fienhold
4,425,965 A 1/1984 Bayh, III et al.
4,432,392 A 2/1984 Paley
D274,457 S 6/1984 Haug
4,461,052 A 7/1984 Mostul
4,465,308 A 8/1984 Martini
4,467,964 A 8/1984 Kaeser
4,495,550 A 1/1985 Visciano
4,527,745 A 7/1985 Butterfield et al.
4,540,202 A 9/1985 Amphoux et al.
4,545,081 A 10/1985 Nestor et al.
4,553,775 A 11/1985 Halling
D281,820 S 12/1985 Oba et al.
4,561,593 A 12/1985 Cammack et al.
4,564,889 A 1/1986 Bolson
4,571,003 A 2/1986 Roling et al.
4,572,232 A 2/1986 Gruber
D283,645 S 4/1986 Tanaka
4,587,991 A 5/1986 Chorkey
4,588,130 A 5/1986 Trenary et al.
4,598,866 A 7/1986 Cammack et al.
4,614,303 A 9/1986 Moseley, Jr. et al.
4,616,298 A 10/1986 Bolson
4,618,100 A 10/1986 White et al.
4,629,124 A 12/1986 Gruber
4,629,125 A 12/1986 Liu
4,643,463 A 2/1987 Halling et al.
4,645,244 A 2/1987 Curtis
RE32,386 E 3/1987 Hunter
4,650,120 A 3/1987 Kress
4,650,470 A 3/1987 Epstein
4,652,025 A 3/1987 Conroy, Sr.
4,654,900 A 4/1987 McGhee
4,657,185 A 4/1987 Rundzaitis
4,669,666 A 6/1987 Finkbeiner
4,669,757 A 6/1987 Bartholomew
4,674,687 A 6/1987 Smith et al.
4,683,917 A 8/1987 Bartholomew
4,703,893 A 11/1987 Gruber
4,717,180 A 1/1988 Roman
4,719,654 A 1/1988 Blessing
4,733,337 A 3/1988 Bieberstein
D295,437 S 4/1988 Fabian
4,739,801 A 4/1988 Kimura et al.
4,749,126 A 6/1988 Kessener et al.
D296,582 S 7/1988 Haug et al.
4,754,928 A 7/1988 Rogers et al.
D297,160 S 8/1988 Robbins
4,764,047 A 8/1988 Johnston et al.
4,778,104 A 10/1988 Fisher
4,787,591 A 11/1988 Villacorta
4,790,294 A 12/1988 Allred, III et al.
4,801,091 A 1/1989 Sandvik
4,809,369 A 3/1989 Bowden
4,839,599 A 6/1989 Fischer
4,841,590 A 6/1989 Terry et al.
4,842,059 A 6/1989 Tomek
D302,325 S 7/1989 Charet et al.
4,850,616 A 7/1989 Pava
4,854,499 A 8/1989 Neuman
4,856,822 A 8/1989 Parker
4,865,362 A 9/1989 Holden
D303,830 S 10/1989 Ramsey et al.
4,871,196 A 10/1989 Kingsford
4,896,658 A 1/1990 Yonekubo et al.
D306,351 S 2/1990 Charet et al.
4,901,927 A 2/1990 Valdivia
4,903,178 A 2/1990 Englot et al.
4,903,897 A 2/1990 Hayes
4,903,922 A 2/1990 Harris, III
4,907,137 A 3/1990 Schladitz et al.
4,907,744 A 3/1990 Jousson
4,909,435 A 3/1990 Kidouchi et al.
4,914,759 A 4/1990 Goff
4,946,202 A 8/1990 Perricone
4,951,329 A 8/1990 Shaw
4,953,585 A 9/1990 Rollini et al.
4,964,573 A 10/1990 Lipski

(56) References Cited

U.S. PATENT DOCUMENTS 4,972,048 A 11/1990 Martin
D313,267 S 12/1990 Lenci et al.
4,976,460 A 12/1990 Newcombe et al.
D314,246 S 1/1991 Bache
D315,191 S 3/1991 Mikol
4,998,673 A 3/1991 Pilolla
5,004,158 A 4/1991 Halem et al.
D317,348 S 6/1991 Geneve et al.
5,020,570 A 6/1991 Cotter
5,022,103 A 6/1991 Faist
5,032,015 A 7/1991 Christianson
5,033,528 A 7/1991 Volcani
5,033,897 A 7/1991 Chen
D319,294 S 8/1991 Kohler, Jr. et al.
D320,064 S 9/1991 Presman
5,046,764 A 9/1991 Kimura et al.
D321,062 S 10/1991 Bonbright
5,058,804 A 10/1991 Yonekubo et al.
D322,119 S 12/1991 Haug et al.
D322,681 S 12/1991 Yuen
5,070,552 A 12/1991 Gentry et al.
D323,545 S 1/1992 Ward
5,082,019 A 1/1992 Tetrault
5,086,878 A 2/1992 Swift
5,090,624 A 2/1992 Rogers
5,100,055 A 3/1992 Rokitenetz et al.
D325,769 S 4/1992 Haug et al.
D325,770 S 4/1992 Haug et al.
5,103,384 A 4/1992 Drohan
D326,311 S 5/1992 Lenci et al.
D327,115 S 6/1992 Rogers
5,121,511 A 6/1992 Sakamoto et al.
D327,729 S 7/1992 Rogers
5,127,580 A 7/1992 Fu-I
5,134,251 A 7/1992 Martin
D328,944 S 8/1992 Robbins
5,141,016 A 8/1992 Nowicki
D329,504 S 9/1992 Yuen
5,143,300 A 9/1992 Cutler
5,145,114 A 9/1992 Monch
5,148,556 A 9/1992 Bottoms et al.
D330,068 S 10/1992 Haug et al.
D330,408 S 10/1992 Thacker
D330,409 S 10/1992 Raffo
5,153,976 A 10/1992 Benchaar et al.
5,154,355 A 10/1992 Gonzalez
5,154,483 A 10/1992 Zeller
5,161,567 A 11/1992 Humpert
5,163,752 A 11/1992 Copeland et al.
5,171,429 A 12/1992 Yasuo
5,172,860 A 12/1992 Yuch
5,172,862 A 12/1992 Heimann et al.
5,172,866 A 12/1992 Ward
D332,303 S 1/1993 Klose
D332,994 S 2/1993 Huen
D333,339 S 2/1993 Klose
5,197,767 A 3/1993 Kimura et al.
D334,794 S 4/1993 Klose
D335,171 S 4/1993 Lenci et al.
5,201,468 A 4/1993 Freier et al.
5,206,963 A 5/1993 Wiens
5,207,499 A 5/1993 Vajda et al.
5,213,267 A 5/1993 Heimann et al.
5,220,697 A 6/1993 Birchfield
D337,839 S 7/1993 Zeller
5,228,625 A 7/1993 Grassberger
5,230,106 A 7/1993 Henkin et al.
D338,542 S 8/1993 Yuen
5,232,162 A 8/1993 Chih
D339,492 S 9/1993 Klose
D339,627 S 9/1993 Klose
D339,848 S 9/1993 Gottwald
5,246,169 A 9/1993 Heimann et al.
5,246,301 A 9/1993 Hirasawa
D340,376 S 10/1993 Klose
5,253,670 A 10/1993 Perrott
5,253,807 A 10/1993 Newbegin
5,254,809 A 10/1993 Martin
D341,007 S 11/1993 Haug et al.
D341,191 S 11/1993 Klose
D341,220 S 11/1993 Eagan
5,263,646 A 11/1993 McCauley
5,265,833 A 11/1993 Heimann et al.
5,268,826 A 12/1993 Greene
5,276,596 A 1/1994 Krenzel
5,277,391 A 1/1994 Haug et al.
5,286,071 A 2/1994 Storage
5,288,110 A 2/1994 Allread
5,294,054 A 3/1994 Benedict et al.
5,297,735 A 3/1994 Heimann et al.
5,297,739 A 3/1994 Allen
D345,811 S 4/1994 Van Deursen et al.
D346,426 S 4/1994 Warshawsky
D346,428 S 4/1994 Warshawsky
D346,430 S 4/1994 Warshawsky
D347,262 S 5/1994 Black et al.
D347,265 S 5/1994 Gottwald
5,316,216 A 5/1994 Cammack et al.
D348,720 S 7/1994 Haug et al.
5,329,650 A 7/1994 Zaccai et al.
D349,947 S 8/1994 Hing-Wah
5,333,787 A 8/1994 Smith et al.
5,333,789 A 8/1994 Garneys
5,340,064 A 8/1994 Heimann et al.
5,340,165 A 8/1994 Sheppard
D350,808 S 9/1994 Warshawsky
5,344,080 A 9/1994 Matsui
5,349,987 A 9/1994 Shieh
5,356,076 A 10/1994 Bishop
5,356,077 A 10/1994 Shames
D352,092 S 11/1994 Warshawsky
D352,347 S 11/1994 Dannenberg
D352,766 S 11/1994 Hill et al.
5,368,235 A 11/1994 Drozdoff et al.
5,369,556 A 11/1994 Zeller
5,370,427 A 12/1994 Hoelle et al.
5,385,500 A 1/1995 Schmidt
D355,242 S 2/1995 Warshawsky
D355,703 S 2/1995 Duell
D356,626 S 3/1995 Wang
5,397,064 A 3/1995 Heitzman
5,398,872 A 3/1995 Joubran
5,398,977 A 3/1995 Berger et al.
5,402,812 A 4/1995 Moineau et al.
5,405,089 A 4/1995 Heimann et al.
5,414,879 A 5/1995 Hiraishi et al.
5,423,348 A 6/1995 Jezek et al.
5,433,384 A 7/1995 Chan et al.
D361,399 S 8/1995 Carbone et al.
D361,623 S 8/1995 Huen
5,441,075 A 8/1995 Clare
5,449,206 A 9/1995 Lockwood
D363,360 S 10/1995 Santarsiero
5,454,809 A 10/1995 Janssen
5,468,057 A 11/1995 Megerle et al.
D364,935 S 12/1995 deBlois
D365,625 S 12/1995 Bova
D365,646 S 12/1995 deBlois
5,476,225 A 12/1995 Chan
D366,309 S 1/1996 Huang
D366,707 S 1/1996 Kaiser
D366,708 S 1/1996 Santarsiero
D366,709 S 1/1996 Szymanski
D366,710 S 1/1996 Szymanski
5,481,765 A 1/1996 Wang
D366,948 S 2/1996 Carbone
D367,315 S 2/1996 Andrus
D367,333 S 2/1996 Swyst
D367,696 S 3/1996 Andrus
D367,934 S 3/1996 Carbone
D368,146 S 3/1996 Carbone
D368,317 S 3/1996 Swyst
5,499,767 A 3/1996 Morand
D368,539 S 4/1996 Carbone et al.

(56) References Cited

U.S. PATENT DOCUMENTS

D368,540 S 4/1996 Santarsiero
D368,541 S 4/1996 Kaiser et al.
D368,542 S 4/1996 deBlois et al.
D369,204 S 4/1996 Andrus
D369,205 S 4/1996 Andrus
5,507,436 A 4/1996 Ruttenberg
D369,873 S 5/1996 deBlois et al.
D369,874 S 5/1996 Santarsiero
D369,875 S 5/1996 Carbone
D370,052 S 5/1996 Chan et al.
D370,250 S 5/1996 Fawcett et al.
D370,277 S 5/1996 Kaiser
D370,278 S 5/1996 Nolan
D370,279 S 5/1996 deBlois
D370,280 S 5/1996 Kaiser
D370,281 S 5/1996 Johnstone et al.
5,517,392 A 5/1996 Rousso et al.
5,521,803 A 5/1996 Eckert et al.
D370,542 S 6/1996 Santarsiero
D370,735 S 6/1996 deBlois
D370,987 S 6/1996 Santarsiero
D370,988 S 6/1996 Santarsiero
D371,448 S 7/1996 Santarsiero
D371,618 S 7/1996 Nolan
D371,619 S 7/1996 Szymanski
D371,856 S 7/1996 Carbone
D372,318 S 7/1996 Szymanski
D372,319 S 7/1996 Carbone
5,531,625 A 7/1996 Zhong
5,539,624 A 7/1996 Dougherty
D372,548 S 8/1996 Carbone
D372,998 S 8/1996 Carbone
D373,210 S 8/1996 Santarsiero
D373,434 S 9/1996 Nolan
D373,435 S 9/1996 Nolan
D373,645 S 9/1996 Johnstone et al.
D373,646 S 9/1996 Szymanski et al.
D373,647 S 9/1996 Kaiser
D373,648 S 9/1996 Kaiser
D373,649 S 9/1996 Carbone
D373,651 S 9/1996 Szymanski
D373,652 S 9/1996 Kaiser
5,551,637 A 9/1996 Lo
5,552,973 A 9/1996 Hsu
5,558,278 A 9/1996 Gallorini
D374,271 S 10/1996 Fleischmann
D374,297 S 10/1996 Kaiser
D374,298 S 10/1996 Swyst
D374,299 S 10/1996 Carbone
D374,493 S 10/1996 Szymanski
D374,494 S 10/1996 Santarsiero
D374,732 S 10/1996 Kaiser
D374,733 S 10/1996 Santasiero
5,560,548 A 10/1996 Mueller et al.
5,567,115 A 10/1996 Carbone
D375,541 S 11/1996 Michaluk
5,577,664 A 11/1996 Heitzman
D376,217 S 12/1996 Kaiser
D376,860 S 12/1996 Santarsiero
D376,861 S 12/1996 Johnstone et al.
D376,862 S 12/1996 Carbone
5,605,173 A 2/1997 Arnaud
D378,401 S 3/1997 Neufeld et al.
5,613,638 A 3/1997 Blessing
5,613,639 A 3/1997 Storm et al.
5,615,837 A 4/1997 Roman
5,624,074 A 4/1997 Parisi
5,624,498 A 4/1997 Lee et al.
D379,212 S 5/1997 Chan
D379,404 S 5/1997 Spelts
5,632,049 A 5/1997 Chen
D381,405 S 7/1997 Waidele et al.
D381,737 S 7/1997 Chan
D382,936 S 8/1997 Shfaram
5,653,260 A 8/1997 Huber
5,667,146 A 9/1997 Pimentel et al.
D385,332 S 10/1997 Andrus
D385,333 S 10/1997 Caroen et al.
D385,334 S 10/1997 Caroen et al.
D385,616 S 10/1997 Dow et al.
D385,947 S 11/1997 Dow et al.
D387,230 S 12/1997 von Buelow et al.
5,697,557 A 12/1997 Blessing et al.
5,699,964 A 12/1997 Bergmann et al.
5,702,057 A 12/1997 Huber
D389,558 S 1/1998 Andrus
5,704,080 A 1/1998 Kuhne
5,707,011 A 1/1998 Bosio
5,718,380 A 2/1998 Schorn et al.
D392,369 S 3/1998 Chan
5,730,361 A 3/1998 Thonnes
5,730,362 A 3/1998 Cordes
5,730,363 A 3/1998 Kress
5,742,961 A 4/1998 Casperson et al.
D394,490 S 5/1998 Andrus et al.
5,746,375 A 5/1998 Guo
5,749,552 A 5/1998 Fan
5,749,602 A 5/1998 Delaney et al.
D394,899 S 6/1998 Caroen et al.
D395,074 S 6/1998 Neibrook
D395,075 S 6/1998 Kolada
D395,142 S 6/1998 Neibrook
5,764,760 A 6/1998 Grandbert et al.
5,765,760 A 6/1998 Kuo
5,769,802 A 6/1998 Wang
5,772,120 A 6/1998 Huber
5,778,939 A 7/1998 Hok-Yin
5,788,157 A 8/1998 Kress
D398,370 S 9/1998 Purdy
5,806,771 A 9/1998 Loschelder et al.
5,819,791 A 10/1998 Chronister et al.
5,820,574 A 10/1998 Henkin et al.
5,823,431 A 10/1998 Pierce
5,823,442 A 10/1998 Guo
5,826,803 A 10/1998 Cooper
5,833,138 A 11/1998 Crane et al.
5,839,666 A 11/1998 Heimann et al.
D402,350 S 12/1998 Andrus
D403,754 S 1/1999 Gottwald
D404,116 S 1/1999 Bosio
5,855,348 A 1/1999 Fornara
5,860,599 A 1/1999 Lin
5,862,543 A 1/1999 Reynoso et al.
5,862,985 A 1/1999 Neibrook et al.
D405,502 S 2/1999 Tse
5,865,375 A 2/1999 Hsu
5,865,378 A 2/1999 Hollinshead et al.
5,873,647 A 2/1999 Kurtz et al.
D408,893 S 4/1999 Tse
D409,276 S 5/1999 Ratzlaff
D410,276 S 5/1999 Ben-Tsur
5,918,809 A 7/1999 Simmons
5,918,811 A 7/1999 Denham et al.
D413,157 S 8/1999 Ratzlaff
5,937,905 A 8/1999 Santos
5,938,123 A 8/1999 Heitzman
5,941,462 A 8/1999 Sandor
5,947,388 A 9/1999 Woodruff
D415,247 S 10/1999 Haverstraw et al.
5,961,046 A 10/1999 Joubran
5,967,417 A * 10/1999 Mantel ..... 239/380
5,979,776 A 11/1999 Williams
5,992,762 A 11/1999 Wang
D418,200 S 12/1999 Ben-Tsur
5,997,047 A 12/1999 Pimentel et al.
6,003,165 A 12/1999 Loyd
D418,902 S 1/2000 Haverstraw et al.
D418,903 S 1/2000 Haverstraw et al.
D418,904 S 1/2000 Milrud
D421,099 S 2/2000 Mullenmeister
6,021,960 A 2/2000 Kehat
D422,053 S 3/2000 Brenner et al.
6,042,027 A 3/2000 Sandvik
6,042,155 A 3/2000 Lockwood

(56) References Cited

U.S. PATENT DOCUMENTS

| | | | |
|---|---|---|---|
| D422,336 | S | 4/2000 | Haverstraw et al. |
| D422,337 | S | 4/2000 | Chan |
| D423,083 | S | 4/2000 | Haug et al. |
| D423,110 | S | 4/2000 | Cipkowski |
| D424,160 | S | 5/2000 | Haug et al. |
| D424,161 | S | 5/2000 | Haug et al. |
| D424,162 | S | 5/2000 | Haug et al. |
| D424,163 | S | 5/2000 | Haug et al. |
| D426,290 | S | 6/2000 | Haug et al. |
| D427,661 | S | 7/2000 | Haverstraw et al. |
| D428,110 | S | 7/2000 | Haug et al. |
| D428,125 | S | 7/2000 | Chan |
| 6,085,780 | A | 7/2000 | Morris |
| D430,267 | S | 8/2000 | Milrud et al. |
| 6,095,801 | A | 8/2000 | Spiewak |
| D430,643 | S | 9/2000 | Tse |
| 6,113,002 | A | 9/2000 | Finkbeiner |
| 6,123,272 | A | 9/2000 | Havican et al. |
| 6,123,308 | A | 9/2000 | Faisst |
| D432,624 | S | 10/2000 | Chan |
| D432,625 | S | 10/2000 | Chan |
| D433,096 | S | 10/2000 | Tse |
| D433,097 | S | 10/2000 | Tse |
| 6,126,091 | A | 10/2000 | Heitzman |
| 6,126,290 | A | 10/2000 | Veigel |
| D434,109 | S | 11/2000 | Ko |
| 6,164,569 | A | 12/2000 | Hollinshead et al. |
| 6,164,570 | A | 12/2000 | Smeltzer |
| D435,889 | S | 1/2001 | Ben-Tsur et al. |
| D439,305 | S | 3/2001 | Slothower |
| 6,199,580 | B1 | 3/2001 | Morris |
| 6,202,679 | B1 | 3/2001 | Titus |
| D440,276 | S | 4/2001 | Slothower |
| D440,277 | S | 4/2001 | Slothower |
| D440,278 | S | 4/2001 | Slothower |
| D441,059 | S | 4/2001 | Fleischmann |
| 6,209,799 | B1 | 4/2001 | Finkbeiner |
| D443,025 | S | 5/2001 | Kollmann et al. |
| D443,026 | S | 5/2001 | Kollmann et al. |
| D443,027 | S | 5/2001 | Kollmann et al. |
| D443,029 | S | 5/2001 | Kollmann et al. |
| 6,223,998 | B1 | 5/2001 | Heitzman |
| 6,230,984 | B1 | 5/2001 | Jager |
| 6,230,988 | B1 | 5/2001 | Chao et al. |
| 6,230,989 | B1 | 5/2001 | Haverstraw et al. |
| D443,335 | S | 6/2001 | Andrus |
| D443,336 | S | 6/2001 | Kollmann et al. |
| D443,347 | S | 6/2001 | Gottwald |
| 6,241,166 | B1 | 6/2001 | Overington et al. |
| 6,250,572 | B1 | 6/2001 | Chen |
| D444,865 | S | 7/2001 | Gottwald |
| D445,871 | S | 7/2001 | Fan |
| 6,254,014 | B1 | 7/2001 | Clearman et al. |
| 6,270,278 | B1 | 8/2001 | Mauro |
| 6,276,004 | B1 | 8/2001 | Bertrand et al. |
| 6,283,447 | B1 | 9/2001 | Fleet |
| 6,286,764 | B1 | 9/2001 | Garvey et al. |
| D449,673 | S | 10/2001 | Kollmann et al. |
| D450,370 | S | 11/2001 | Wales et al. |
| D450,805 | S | 11/2001 | Lindholm et al. |
| D450,806 | S | 11/2001 | Lindholm et al. |
| D450,807 | S | 11/2001 | Lindholm et al. |
| D451,169 | S | 11/2001 | Lindholm et al. |
| D451,170 | S | 11/2001 | Lindholm et al. |
| D451,171 | S | 11/2001 | Lindholm et al. |
| D451,172 | S | 11/2001 | Lindholm et al. |
| 6,321,777 | B1 | 11/2001 | Wu |
| 6,322,006 | B1 | 11/2001 | Guo |
| D451,583 | S | 12/2001 | Lindholm et al. |
| D451,980 | S | 12/2001 | Lindholm et al. |
| D452,553 | S | 12/2001 | Lindholm et al. |
| D452,725 | S | 1/2002 | Lindholm et al. |
| D452,897 | S | 1/2002 | Gillette et al. |
| 6,336,764 | B1 | 1/2002 | Liu |
| 6,338,170 | B1 | 1/2002 | De Simone |
| D453,369 | S | 2/2002 | Lobermeier |
| D453,370 | S | 2/2002 | Lindholm et al. |
| D453,551 | S | 2/2002 | Lindholm et al. |
| 6,349,735 | B2 | 2/2002 | Gul |
| D454,617 | S | 3/2002 | Curbbun et al. |
| D454,938 | S | 3/2002 | Lord |
| 6,375,342 | B1 | 4/2002 | Koren et al. |
| D457,937 | S | 5/2002 | Lindholm et al. |
| 6,382,531 | B1 | 5/2002 | Tracy |
| D458,348 | S | 6/2002 | Mullenmeister |
| 6,412,711 | B1 | 7/2002 | Fan |
| D461,224 | S | 8/2002 | Lobermeier |
| D461,878 | S | 8/2002 | Green et al. |
| 6,450,425 | B1 | 9/2002 | Chen |
| 6,454,186 | B2 | 9/2002 | Haverstraw et al. |
| 6,463,658 | B1 | 10/2002 | Larsson |
| 6,464,265 | B1 | 10/2002 | Mikol |
| D465,552 | S | 11/2002 | Tse |
| D465,553 | S | 11/2002 | Singtoroj |
| 6,484,952 | B2 | 11/2002 | Koren |
| D468,800 | S | 1/2003 | Tse |
| D469,165 | S | 1/2003 | Lim |
| 6,502,796 | B1 | 1/2003 | Wales |
| 6,508,415 | B2 | 1/2003 | Wang |
| 6,511,001 | B1 | 1/2003 | Huang |
| D470,219 | S | 2/2003 | Schweitzer |
| 6,516,070 | B2 | 2/2003 | Macey |
| D471,253 | S | 3/2003 | Tse |
| D471,953 | S | 3/2003 | Colligan et al. |
| 6,533,194 | B2 | 3/2003 | Marsh et al. |
| 6,537,455 | B2 | 3/2003 | Farley |
| D472,958 | S | 4/2003 | Ouyoung |
| 6,550,697 | B2 | 4/2003 | Lai |
| 6,585,174 | B1 | 7/2003 | Huang |
| 6,595,439 | B1 | 7/2003 | Chen |
| 6,607,148 | B1 | 8/2003 | Marsh et al. |
| 6,611,971 | B1 | 9/2003 | Antoniello et al. |
| 6,637,676 | B2 | 10/2003 | Zieger et al. |
| 6,641,057 | B2 | 11/2003 | Thomas et al. |
| D483,837 | S | 12/2003 | Fan |
| 6,659,117 | B2 | 12/2003 | Gilmore |
| 6,659,372 | B2 | 12/2003 | Marsh et al. |
| D485,887 | S | 1/2004 | Luettgen et al. |
| D486,888 | S | 2/2004 | Lobermeier |
| 6,691,338 | B2 | 2/2004 | Zieger |
| 6,691,933 | B1 | 2/2004 | Bosio |
| D487,301 | S | 3/2004 | Haug et al. |
| D487,498 | S | 3/2004 | Blomstrom |
| 6,701,953 | B2 | 3/2004 | Agosta |
| 6,715,699 | B1 | 4/2004 | Greenberg et al. |
| 6,719,218 | B2 | 4/2004 | Cool et al. |
| D489,798 | S | 5/2004 | Hunt |
| D490,498 | S | 5/2004 | Golichowski |
| 6,736,336 | B2 | 5/2004 | Wong |
| 6,739,523 | B2 | 5/2004 | Haverstraw et al. |
| 6,739,527 | B1 | 5/2004 | Chung |
| D492,004 | S | 6/2004 | Haug et al. |
| D492,007 | S | 6/2004 | Kollmann et al. |
| 6,742,725 | B1 | 6/2004 | Fan |
| D493,208 | S | 7/2004 | Lin |
| D493,864 | S | 8/2004 | Haug et al. |
| D494,655 | S | 8/2004 | Lin |
| D494,661 | S | 8/2004 | Zieger et al. |
| D495,027 | S | 8/2004 | Mazzola |
| 6,776,357 | B1 | 8/2004 | Naito |
| 6,789,751 | B1 | 9/2004 | Fan |
| D496,987 | S | 10/2004 | Glunk |
| D497,974 | S | 11/2004 | Haug et al. |
| D498,514 | S | 11/2004 | Haug et al. |
| D500,121 | S | 12/2004 | Blomstrom |
| D500,549 | S | 1/2005 | Blomstrom |
| D501,242 | S | 1/2005 | Blomstrom |
| D502,760 | S | 3/2005 | Zieger et al. |
| D502,761 | S | 3/2005 | Zieger et al. |
| D503,211 | S | 3/2005 | Lin |
| 6,863,227 | B2 | 3/2005 | Wollenberg et al. |
| 6,869,030 | B2 | 3/2005 | Blessing et al. |
| D503,774 | S | 4/2005 | Zieger |
| D503,775 | S | 4/2005 | Zieger |

(56) References Cited

U.S. PATENT DOCUMENTS

| | | | |
|---|---|---|---|
| D503,966 | S | 4/2005 | Zieger |
| 6,899,292 | B2 | 5/2005 | Titinet |
| D506,243 | S | 6/2005 | Wu |
| D507,037 | S | 7/2005 | Wu |
| 6,935,581 | B2 | 8/2005 | Titinet |
| D509,280 | S | 9/2005 | Bailey et al. |
| D509,563 | S | 9/2005 | Bailey et al. |
| D510,123 | S | 9/2005 | Tsai |
| D511,809 | S | 11/2005 | Haug et al. |
| D512,119 | S | 11/2005 | Haug et al. |
| 6,981,661 | B1 | 1/2006 | Chen |
| D516,169 | S | 2/2006 | Wu |
| 7,000,854 | B2 | 2/2006 | Malek et al. |
| 7,004,409 | B2 | 2/2006 | Okubo |
| 7,004,410 | B2 | 2/2006 | Li |
| D520,109 | S | 5/2006 | Wu |
| 7,040,554 | B2 | 5/2006 | Drennow |
| 7,048,210 | B2 | 5/2006 | Clark |
| 7,055,767 | B1 | 6/2006 | Ko |
| 7,070,125 | B2 | 7/2006 | Williams et al. |
| 7,077,342 | B2 | 7/2006 | Lee |
| D527,440 | S | 8/2006 | Macan |
| 7,093,780 | B1 | 8/2006 | Chung |
| 7,097,122 | B1 | 8/2006 | Farley |
| D528,631 | S | 9/2006 | Gillette et al. |
| 7,100,845 | B1 | 9/2006 | Hsieh |
| 7,111,795 | B2 | 9/2006 | Thong |
| 7,111,798 | B2 | 9/2006 | Thomas et al. |
| D530,389 | S | 10/2006 | Genslak et al. |
| D530,392 | S | 10/2006 | Tse |
| D531,259 | S | 10/2006 | Hsieh |
| 7,114,666 | B2 | 10/2006 | Luettgen et al. |
| D533,253 | S | 12/2006 | Luettgen et al. |
| D534,239 | S | 12/2006 | Dingler et al. |
| D535,354 | S | 1/2007 | Wu |
| D536,060 | S | 1/2007 | Sadler |
| 7,156,325 | B1 | 1/2007 | Chen |
| D538,391 | S | 3/2007 | Mazzola |
| D540,424 | S | 4/2007 | Kirar |
| D540,425 | S | 4/2007 | Endo et al. |
| D540,426 | S | 4/2007 | Cropelli |
| D540,427 | S | 4/2007 | Bouroullec et al. |
| D542,391 | S | 5/2007 | Gilbert |
| D542,393 | S | 5/2007 | Haug et al. |
| 7,229,031 | B2 | 6/2007 | Schmidt |
| 7,243,863 | B2 | 7/2007 | Glunk |
| 7,246,760 | B2 | 7/2007 | Marty et al. |
| D552,713 | S | 10/2007 | Rexach |
| 7,278,591 | B2 | 10/2007 | Clearman et al. |
| D556,295 | S | 11/2007 | Genord et al. |
| 7,299,510 | B2 | 11/2007 | Tsai |
| D557,763 | S | 12/2007 | Schonherr et al. |
| D557,764 | S | 12/2007 | Schonherr et al. |
| D557,765 | S | 12/2007 | Schonherr et al. |
| D558,301 | S | 12/2007 | Hoernig |
| 7,303,151 | B2 | 12/2007 | Wu |
| D559,357 | S | 1/2008 | Wang et al. |
| D559,945 | S | 1/2008 | Patterson et al. |
| D560,269 | S | 1/2008 | Tse |
| D562,937 | S | 2/2008 | Schonherr et al. |
| D562,938 | S | 2/2008 | Blessing |
| D562,941 | S | 2/2008 | Pan |
| 7,331,536 | B1 | 2/2008 | Zhen et al. |
| 7,347,388 | B2 | 3/2008 | Chung |
| D565,699 | S | 4/2008 | Berberet |
| D565,702 | S | 4/2008 | Daunter et al. |
| D565,703 | S | 4/2008 | Lammel et al. |
| D566,228 | S | 4/2008 | Neagoe |
| D566,229 | S | 4/2008 | Rexach |
| D567,328 | S | 4/2008 | Spangler et al. |
| 7,360,723 | B2 | 4/2008 | Lev |
| 7,364,097 | B2 | 4/2008 | Okuma |
| 7,374,112 | B1 | 5/2008 | Bulan et al. |
| 7,384,007 | B2 | 6/2008 | Ho |
| D577,099 | S | 9/2008 | Leber |
| D577,793 | S | 9/2008 | Leber |
| D580,012 | S | 11/2008 | Quinn et al. |
| D580,513 | S | 11/2008 | Quinn et al. |
| D581,013 | S | 11/2008 | Citterio |
| D581,014 | S | 11/2008 | Quinn et al. |
| 7,503,345 | B2 | 3/2009 | Paterson et al. |
| D590,048 | S | 4/2009 | Leber et al. |
| 7,520,448 | B2 | 4/2009 | Luettgen et al. |
| D592,276 | S | 5/2009 | Schoenherr et al. |
| D592,278 | S | 5/2009 | Leber |
| 7,537,175 | B2 | 5/2009 | Miura et al. |
| D600,777 | S | 9/2009 | Whitaker et al. |
| D603,935 | S | 11/2009 | Leber |
| D605,731 | S | 12/2009 | Leber |
| D606,623 | S | 12/2009 | Whitaker et al. |
| D608,412 | S | 1/2010 | Barnard et al. |
| D608,413 | S | 1/2010 | Barnard et al. |
| D616,061 | S | 5/2010 | Whitaker et al. |
| D621,904 | S | 8/2010 | Yoo et al. |
| D621,905 | S | 8/2010 | Yoo et al. |
| 7,832,662 | B2 | 11/2010 | Gallo |
| D628,676 | S | 12/2010 | Lee |
| D629,867 | S | 12/2010 | Rexach et al. |
| 8,366,024 | B2 * | 2/2013 | Leber ..... 239/381 |
| 2002/0109023 | A1 | 8/2002 | Thomas et al. |
| 2003/0062426 | A1 | 4/2003 | Gregory et al. |
| 2003/0121993 | A1 | 7/2003 | Haverstraw et al. |
| 2004/0074993 | A1 | 4/2004 | Thomas et al. |
| 2004/0118949 | A1 | 6/2004 | Marks |
| 2004/0217209 | A1 | 11/2004 | Bui |
| 2004/0244105 | A1 | 12/2004 | Tsai |
| 2005/0001072 | A1 | 1/2005 | Bolus et al. |
| 2005/0283904 | A1 | 12/2005 | Macan et al. |
| 2005/0284967 | A1 | 12/2005 | Korb |
| 2006/0016908 | A1 | 1/2006 | Chung |
| 2006/0016913 | A1 | 1/2006 | Lo |
| 2006/0043214 | A1 | 3/2006 | Macan et al. |
| 2006/0060678 | A1 | 3/2006 | Mazzola |
| 2006/0102747 | A1 | 5/2006 | Ho |
| 2006/0157590 | A1 | 7/2006 | Clearman et al. |
| 2006/0163391 | A1 | 7/2006 | Schorn |
| 2006/0219822 | A1 | 10/2006 | Miller et al. |
| 2006/0283986 | A1 | 12/2006 | Chung |
| 2007/0040054 | A1 | 2/2007 | Farzan |
| 2007/0200013 | A1 | 8/2007 | Hsiao |
| 2007/0246577 | A1 | 10/2007 | Leber |
| 2007/0252021 | A1 | 11/2007 | Cristina |
| 2007/0272770 | A1 | 11/2007 | Leber et al. |
| 2008/0073449 | A1 | 3/2008 | Haynes et al. |
| 2008/0083844 | A1 | 4/2008 | Leber et al. |
| 2008/0111004 | A1 | 5/2008 | Huffman |
| 2008/0121293 | A1 | 5/2008 | Leber et al. |
| 2008/0156897 | A1 | 7/2008 | Leber |
| 2008/0156902 | A1 | 7/2008 | Luettgen et al. |
| 2008/0156903 | A1 | 7/2008 | Leber |
| 2008/0223957 | A1 | 9/2008 | Schorn |
| 2008/0272203 | A1 | 11/2008 | Leber |
| 2008/0272591 | A1 | 11/2008 | Leber |
| 2009/0200404 | A1 | 8/2009 | Cristina |
| 2009/0218420 | A1 | 9/2009 | Mazzola |
| 2009/0307836 | A1 | 12/2009 | Blattner et al. |
| 2010/0065665 | A1 | 3/2010 | Whitaker |
| 2010/0320290 | A1 | 12/2010 | Luettgen et al. |
| 2011/0000982 | A1 | 1/2011 | Luettgen et al. |
| 2011/0000983 | A1 | 1/2011 | Chang |
| 2011/0011953 | A1 | 1/2011 | Macan et al. |

FOREIGN PATENT DOCUMENTS

| | | |
|---|---|---|
| DE | 352813 | 5/1922 |
| DE | 848627 | 9/1952 |
| DE | 854100 | 10/1952 |
| DE | 2360534 | 6/1974 |
| DE | 2806093 | 8/1979 |
| DE | 3107808 | 9/1982 |
| DE | 3246327 | 6/1984 |
| DE | 3440901 | 7/1985 |
| DE | 3706320 | 3/1988 |
| DE | 8804236 | 6/1988 |

(56) References Cited

FOREIGN PATENT DOCUMENTS

| | | |
|---|---|---|
| DE | 4034695 | 5/1991 |
| DE | 19608085 | 9/1996 |
| DE | 102006032017 | 1/2008 |
| EP | 0167063 | 6/1985 |
| EP | 0478999 | 4/1992 |
| EP | 0514753 | 11/1992 |
| EP | 0435030 | 7/1993 |
| EP | 0683354 | 11/1995 |
| EP | 0687851 | 12/1995 |
| EP | 0695907 | 2/1996 |
| EP | 0700729 | 3/1996 |
| EP | 0719588 | 7/1996 |
| EP | 0721082 | 7/1996 |
| EP | 0733747 | 9/1996 |
| EP | 0808661 | 11/1997 |
| EP | 0726811 | 1/1998 |
| EP | 2164642 | 10/2010 |
| EP | 2260945 | 12/2010 |
| FR | 538538 | 6/1922 |
| FR | 873808 | 7/1942 |
| FR | 1039750 | 10/1953 |
| FR | 1098836 | 8/1955 |
| FR | 2596492 | 10/1987 |
| FR | 2695452 | 3/1994 |
| GB | 3314 | 0/1914 |
| GB | 10086 | 0/1894 |
| GB | 129812 | 7/1919 |
| GB | 204600 | 10/1923 |
| GB | 634483 | 3/1950 |
| GB | 971866 | 10/1964 |
| GB | 1111126 | 4/1968 |
| GB | 2066074 | 1/1980 |
| GB | 2066704 | 7/1981 |
| GB | 2068778 | 8/1981 |
| GB | 2121319 | 12/1983 |
| GB | 2155984 | 10/1985 |
| GB | 2156932 A | 10/1985 |
| GB | 2199771 | 7/1988 |
| GB | 2298595 | 11/1996 |
| GB | 2337471 | 11/1999 |
| IT | 327400 | 7/1935 |
| IT | 350359 | 7/1937 |
| IT | 563459 | 5/1957 |
| JP | S63-181459 | 11/1988 |
| JP | H2-78660 | 6/1990 |
| JP | 4062238 | 2/1992 |
| JP | 4146708 | 5/1992 |
| NL | 8902957 | 6/1991 |
| WO | WO93/12894 | 7/1993 |
| WO | WO93/25839 | 12/1993 |
| WO | WO96/00617 | 1/1996 |
| WO | WO98/30336 | 7/1998 |
| WO | WO99/59726 | 11/1999 |
| WO | WO00/10720 | 3/2000 |
| WO | WO2010/004593 | 1/2010 |

OTHER PUBLICATIONS

Color Copy, Labeled 1B, Gemlo, available at least as early as Dec. 2, 1998.

Author Unknown, "Flipside: The Bolder Look of Kohler," 1 page, at least as early as Jun. 2011.

* cited by examiner

LOW-SPEED PULSATING SHOWERHEAD

CROSS-REFERENCE TO RELATED APPLICATIONS

This application is a continuation-in-part of U.S. application Ser. No. 11/964,670 filed 26 Dec. 2007 entitled "Low speed pulsating showerhead", which claims the benefit under 35 U.S.C. §119(e) to U.S. Provisional Application No. 60/882,441 filed on 28 Dec. 2006 entitled "Low speed pulsating showerhead," each of which is hereby incorporated by reference herein in its entirety.

BACKGROUND

1. Technical Field

The technology disclosed herein relates generally to showerheads, and more specifically to pulsating showerheads.

2. Background Art

Showers provide an alternative to bathing in a bathtub. Generally, showerheads are used to direct water from the home water supply onto a user for personal hygiene purposes.

In the past, bathing was the overwhelmingly popular choice for personal cleansing. However, in recent years showers have become increasingly popular for several reasons. First, showers generally take less time than baths. Second, showers generally use significantly less water than baths. Third, shower stalls and bathtubs with showerheads are typically easier to maintain. Fourth, showers tend to cause less soap scum build-up. Fifth, by showering, a bather does not sit in dirty water—the dirty water is constantly rinsed away.

With the increase in popularity of showers has come an increase in showerhead designs and showerhead manufacturers. Many showerheads emit pulsating streams of water in a so-called "massage" mode. Other showerheads are referred to as "drenching" showerheads, since they have relatively large faceplates and emit water in a steady, soft spray pattern.

The information included in this Background section of the specification, including any references cited herein and any description or discussion thereof, is included for technical reference purposes only and is not to be regarded subject matter by which the scope of the invention is to be bound.

SUMMARY

Various embodiments of a showerhead may include a housing, a turbine, and a shutter. The housing may define a chamber in fluid communication with a fluid inlet and at least one fluid outlet. The turbine may be received within the chamber. The shutter may be received within the chamber and operatively associated with the turbine. Rotation of the turbine may cause rotation of the shutter. A rotation rate of the shutter may be less than a rotation rate of the turbine. As the shutter rotates, the shutter may fluidly connect and disconnect the fluid inlet and the at least one fluid outlet.

In some embodiments, a showerhead may include a housing defining a chamber in fluid communication with a fluid inlet and at least one fluid outlet. The housing may further include a first engagement feature. The showerhead may further include a turbine received within the chamber, a shutter received within the chamber and operatively associated with the turbine. The shutter may include a second engagement feature. The first engagement feature may be disposed radially inward with respect to the at least one fluid outlet. Rotation of the turbine may cause rotation of the shutter. Engagement of the first engagement feature with the second engagement feature may cause a rotation rate of the shutter to be less than a rotation rate of the turbine and, as the shutter rotates, the shutter may fluidly connect and disconnect the fluid inlet and the at least one fluid outlet.

In various embodiments, a showerhead may include a housing defining a chamber in fluid communication with a fluid inlet and at least one fluid outlet. The housing may include a first engagement feature disposed radially inward with respect to the at least one fluid outlet. The showerhead may further include a cycloidal drive. The cycloidal drive may include a turbine received within the chamber, a shutter received within the chamber and operatively associated with the turbine, and the first engagement feature. The turbine may include an eccentric cam. The shutter may include a second engagement feature and an opening for receiving the eccentric cam. Rotation of the turbine may cause rotation of the shutter and engagement of the first engagement feature with the second engagement feature may cause a rotation rate of the shutter to be less than a rotation rate of the turbine.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention is provided in the following written description of various embodiments of the invention, illustrated in the accompanying drawings, and defined in the appended claims.

DETAILED DESCRIPTION

Implementations of showerheads for generating a relatively low speed pulsating spray are described herein. A showerhead may include a jet disk, a turbine, a shutter, and a housing. Water flowing through the showerhead causes the turbine to spin. As the turbine spins, it rotates the shutter. The shutter may be configured to rotate at a slower speed than the turbine to produce a periodic interruption of water flow through outlets or nozzles defined in, or attached to, the housing to create a pulsating spray. This pulsating spray may simulate the feel of a hand massage.

The shutter may take the form of a generally circular disk including gear teeth that selectively engage opposing gear teeth in the housing. The turbine may include an offset cam that drives the shutter. The speed reduction achieved is the ratio of the difference between the number of gear teeth on the housing and the number of gear teeth on the shutter to the number of gear teeth on the shutter. Expressed mathematically, this may be written as: (Housing Teeth-Shutter Teeth)/(Shutter Teeth).

Figure 1:
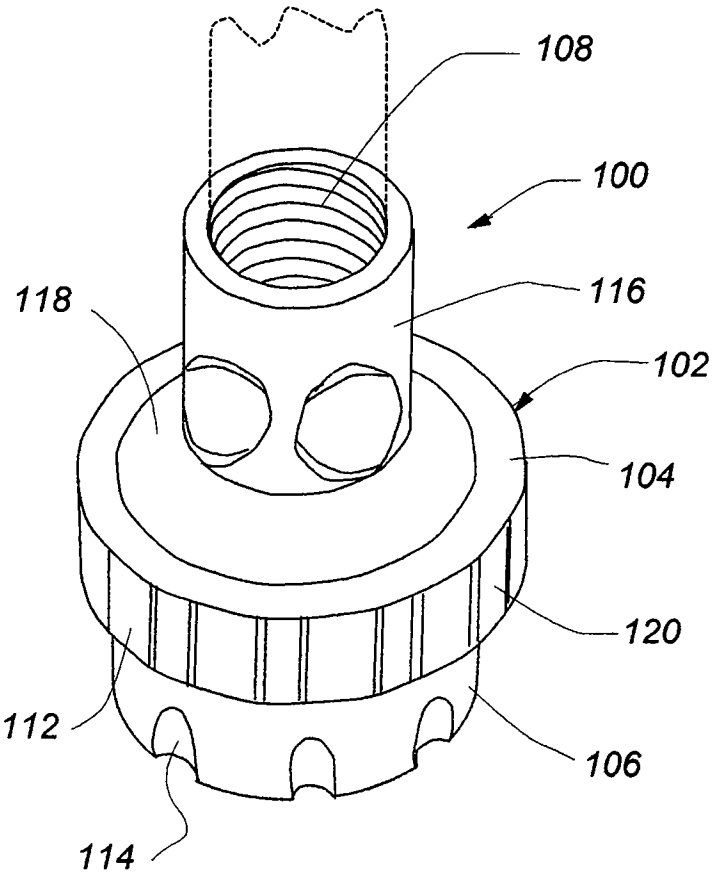
FIG. 1 depicts a rear isometric view of a first embodiment of a showerhead.
Figure 2:
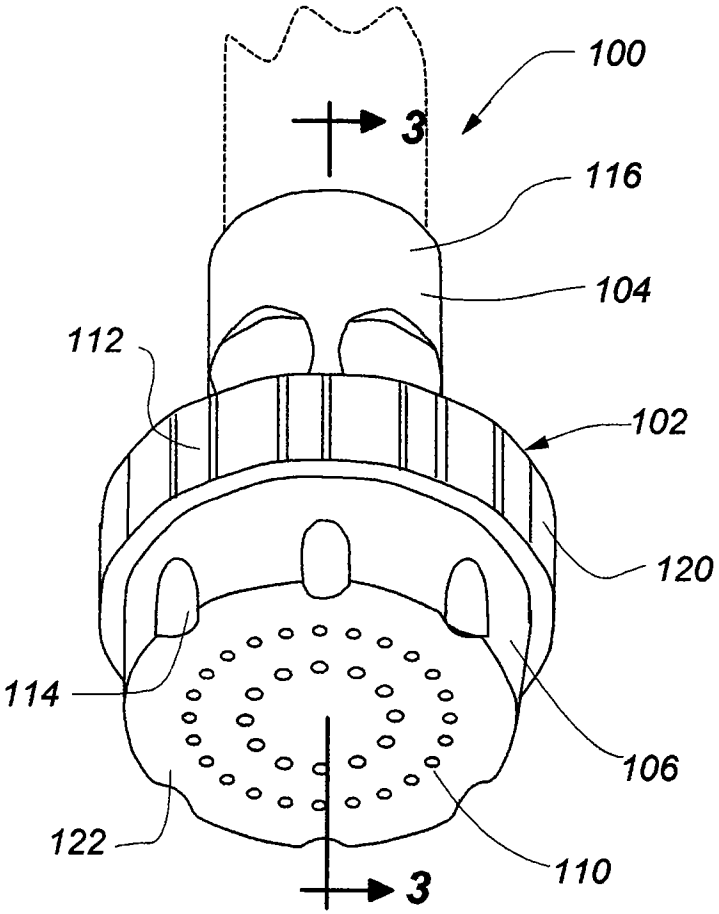
FIG. 2 depicts a front isometric view of the showerhead shown in FIG. 1.

FIGS. 1-15 depict various views of a first embodiment of a showerhead 100. With reference to FIGS. 1 and 2, the showerhead 100 may include a housing 102. The housing 102 may be formed from an upper housing portion 104 and a lower housing portion 106. The upper housing portion 104 may include a fluid inlet for receiving fluid from a fluid source. The upper housing portion 104 may further include threads 108 proximate the fluid inlet for threadedly joining the showerhead 100 to a fluid source, e.g., a shower pipe, flexible arm, hose connector, arm assembly, or other device for conveying fluid, such as water, (i.e., a fluid source) to the showerhead 100. Although shown as threadedly joined to the fluid conveying device, the showerhead 100 may be attached to the fluid conveying device using any known connection method or combination of methods, including, but not limited to, press fitting, clamping, welding, and so on. The lower housing portion 106 may include one or more fluid outlets 110 in selective fluid communication with the fluid inlet. The fluid outlets 110 may be generally circular holes or any other suitably shaped hole or opening. A fluid, such as water, may be delivered from a fluid source to a user via the showerhead 100 through at least one of the fluid outlets 110.

The upper housing portion 104, the lower housing portion 106, or both portions may include user engagement features to facilitate joining the portions. For example, the upper and lower portions 104, 106 as shown in FIGS. 1 and 2 may each include recessed surfaces 112, 114 for providing a surface for a user to grip. In other embodiments, the upper housing portion 104, the lower housing portion 106, or both may incorporate other types of user engagement features, or combinations of features, such as raised protrusions, tabs, knurls, roughened surfaces, and so on, that may enhance a user's grip on the upper housing portion 104, the lower housing portion 106, or both portions for joining the portions, moving the showerhead 100 relative to a shower pipe or other device for conveying fluid to the showerhead, and/or selecting a showerhead operating mode.

Figure 3:
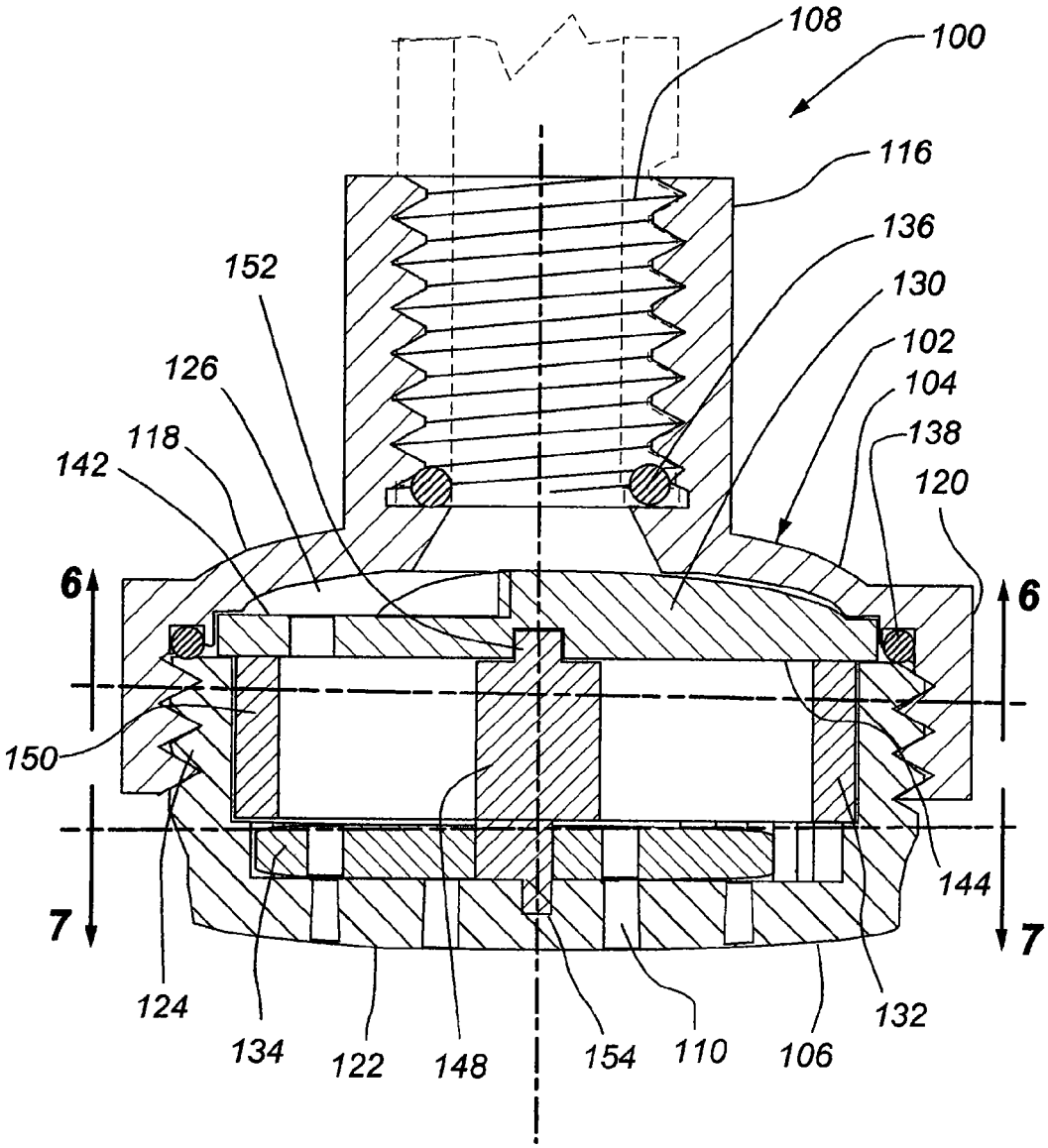
FIG. 3 depicts a cross-section view of the showerhead shown in FIG. 1, viewed along line 3-3 in FIG. 2.
Figure 4:
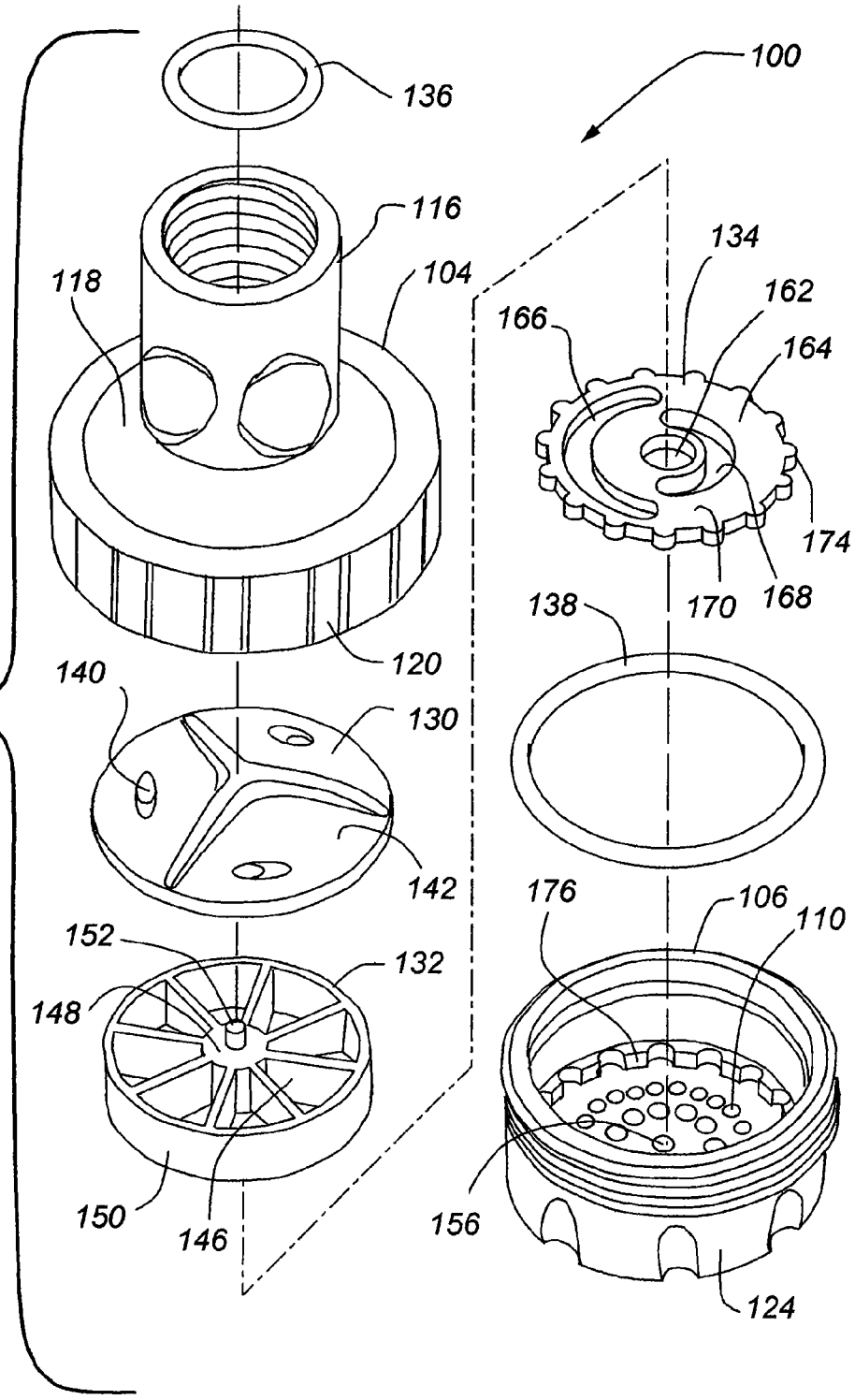
FIG. 4 depicts an exploded rear isometric view of the showerhead shown in FIG. 1.
Figure 5:
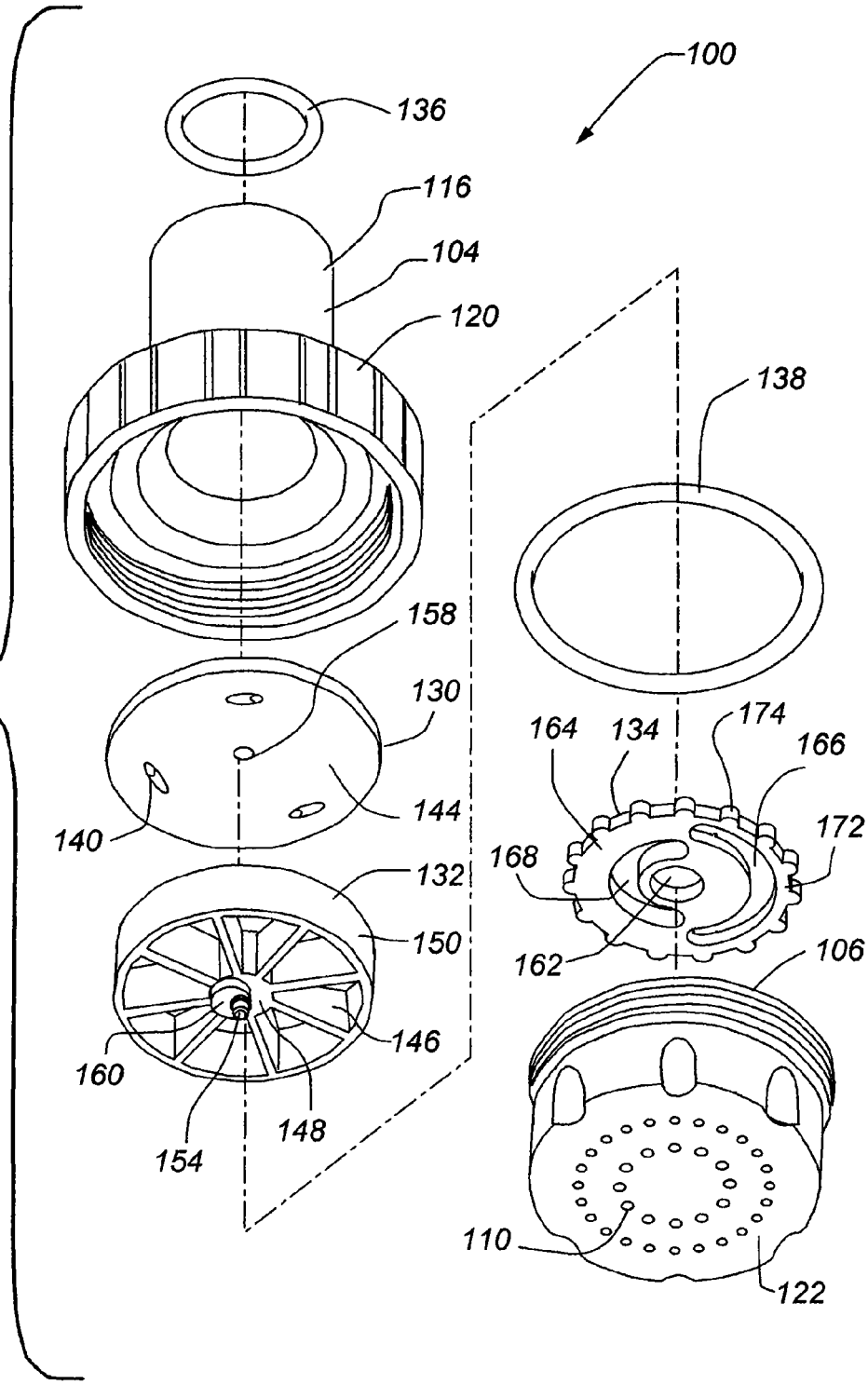
FIG. 5 depicts an exploded front isometric view of the showerhead shown in FIG. 1.

Turning to FIGS. 3-5, the upper housing portion 104 may include a generally cylindrical housing shaft 116 defining a fluid passage. The fluid passage may be in fluid communication with the fluid inlet. A generally annular housing flange 118 may extend radially outward from a lower portion of the housing shaft 116. A generally circular upper housing sidewall 120 may extend generally downward from the housing flange 118. An inner surface of the upper housing sidewall 120 may include threads for joining the upper housing portion 104 to the lower housing portion 106. A flow restrictor (not shown), as known in the art, may be positioned in the fluid passage to limit fluid flow through the showerhead 100 from a fluidly connected fluid source.

The lower housing portion 106 may include a generally circular lower housing base 122. A generally circular lower housing sidewall 124 may extend upward from the lower housing base 122. An external surface of the lower housing sidewall 124 may include threads configured to engage the upper housing threads.

The upper and lower housing threads may be engaged to join the upper housing portion 104 to the lower housing portion 106. Although the upper housing threads are shown as internal threads and the lower housing threads are shown as external threads, the upper housing threads could be external and the lower housing threads could be internal. Further, the upper and lower housing portions 104, 106 may be joined by any known connection method, including, but not limited to, press fitting, clamping, welding, the aforementioned threading, and so on.

The upper housing portion 104 and the lower housing portion 106 may define a chamber or cavity 126. The chamber or cavity 126 may be defined by the upper housing flange 118, the lower housing sidewall 124, and the lower housing base 122. The chamber or cavity 126 may be generally cylindrical in shape or any other desired shape. The chamber or cavity 126 may be in fluid communication with the upper housing fluid passage and in selective fluid communication with the fluid outlets 110.

Although the shape and configuration of the upper and lower housing portions 104, 106 are described and shown with a certain particularity, the upper and lower housing portions 104, 106 may take the form of any desired shape to define the exterior and the interior of the housing 102. Further, the housing 102 may be formed from more or less than two housing portions. Yet further, although the housing 102 is shown as including one fluid inlet, one fluid passage, and one chamber or cavity, the housing may include or define more than one of any of these elements. For example, the housing 102 may define two fluid inlets, two fluid passages, and/or two chambers or cavities. The foregoing example is merely illustrative and is not intended to imply for the housing 102 any particular number or arrangement of fluid inlets, fluid passages, or chambers or cavities.

With continued reference to FIGS. 3-5, the showerhead 100 may further include a jet disk 130, a turbine 132, a shutter 134, and one or more sealing members 136, 138. The jet disk 130, the turbine 132, and the shutter 134 may be received within the cavity or chamber 126 defined by the housing 102. A fluid source seal member 136 may be positioned within the fluid inlet of the upper housing portion 104, and a housing seal member 138 may be positioned between the upper and lower housing portions 104, 106 proximate the area where these portions are joined.

The jet disk 130 may include a generally circular and planar body or any other suitably shaped body. The jet disk 130 may include one or more jet disk fluid jets or openings 140. Although three jets 140 are shown in FIGS. 4 and 5, the jet disk 130 may include more or less than three jets. Each jet 130 may extend from an upper to a lower surface 142, 144 of the jet disk 130, thus creating a path for fluid to flow from the jet disk's upper surface 142 to its lower surface 144. Further, the jets 140 may be angled relative to the jet disk's upper and lower surfaces 142, 144 to impart a directional flow to fluid passing through them. Such directional flow may cause the turbine 132 to rotate within the showerhead cavity 126. The jets 140 may also be shrouded, which may increase the fluid's flow speed. Alternative embodiments may vary the number of jets 140 employed and/or the shrouding configuration.

The turbine 132 may take the form of a generally hollow open-ended cylinder with blades 146 extending radially inward toward a central hub 148 from a generally circular turbine wall 150. The turbine wall 150, or at least a portion of the turbine wall 150, may be omitted in some embodiments. Further, the number of blades 146 may be more or less than the number depicted in the figures. The turbine 132 may include a first pin-shaped extrusion 152 extending generally upward from its upper side and a second pin-shaped extrusion 154 extending generally downward from its lower side. Each pin-shaped extrusion 152, 154 may be located along a central axis of the turbine 132. The lower pin-shaped extrusion 154 may be received in an opening 156 in the housing 102 and the upper pin-shaped extrusion 152 may be received in an opening 158 in the jet disk 130. The turbine 132 may rotate about its central axis (i.e., about the pin-shaped extrusions 152, 154). Alternatively, the turbine 132 may have an upper opening that receives a pin shaped extrusion extending from a lower side of the jet disk 130 and a lower opening that receives a pin shaped extrusion extending from the housing 102. The turbine 132 may include an eccentric cam 160 on its lower side (i.e., the side facing the shutter 134).

The shutter 134 may take the form of a generally circular and planar body or any other desired shape and may include an opening 162 along its central axis to receive the eccentric cam 160. The shutter 134 may thus spin about the central axis of the eccentric cam 160 as the turbine 132 rotates. The center of the eccentric cam 160 is off-center with respect to the center axis of the turbine 132 and housing 102. Thus, as the turbine 132 spins, the eccentric cam 160 moves the center of the shutter 134 in a generally circular path around the center axis of the turbine 132 and the housing 102. As the center of the shutter 134 moves in this generally circular path, the portion of its perimeter that engages or otherwise contacts the lower housing portion's side wall 124 changes as shown, for example, in FIGS. 7-15.

The shutter body 164 may include one or more fluid openings 166, 168 through its thickness for water to pass from the upper side 170 to the lower side 172 of the shutter 134. The shutter fluid openings 166, 168 may be selectively aligned with at least some of the outlets 110 in the housing 102. When aligned, water or other fluid may flow from the housing chamber or cavity 126 and out of the outlets 110 aligned with the shutter fluid openings 166, 168. The shutter 134 may include an engagement feature 174, which may take the form of gear teeth or the like. The gear teeth may be, although not necessarily, uniformly distributed around the shutter body's periphery.

The housing 102 may include a housing engagement feature 176 to engage the shutter's engagement feature 174. The housing engagement feature 176 may be engaging teeth complementary to the shutter's gear teeth 174. For example, the housing engagement feature 176 may be defined in an upper surface 222 of the lower housing 106 by a circular-shaped recessed area with depressions having a complementary shape to the gear teeth of the engagement feature 174 of shutter 134. These may be, but not necessarily, equally spaced around the interior periphery of the lower housing portion 106. As shown, for example, in FIG. 7, the shutter 134 may include fifteen gear teeth, and the housing 102 may include sixteen housing teeth. Other embodiments may use a different number of gear teeth for the shutter 134 and/or housing 102. At least some of the shutter's gear teeth 174 may engage the housing's gear teeth 176. Further, as the turbine 132 rotates, the gear teeth 174 of the shutter 134 that engage the gear teeth 176 of the housing 102 may change.

Returning to FIGS. 3-5, the fluid source seal member 136 may form a fluid seal between the showerhead 100 and a fluid source joined to the showerhead 100. More particularly, the fluid source seal member 136 may substantially limit or otherwise prevent fluid leakage from the showerhead 100 along the threaded joint that joins that fluid source to the showerhead 100. The housing seal member 138 may form a fluid seal between the upper and lower housing portions 104, 106 to substantially limit or otherwise prevent fluid leakage from the showerhead 100 along the threaded joint that joins the upper housing portion 104 to the lower housing portion 106. The fluid source and housing seal members 136, 138 may take the form of O-rings or any other suitable element that provides a fluid seal between two or more members or components and may be composed of an elastomeric material, such as rubber, or any other known fluid sealant material.

Figure 6:
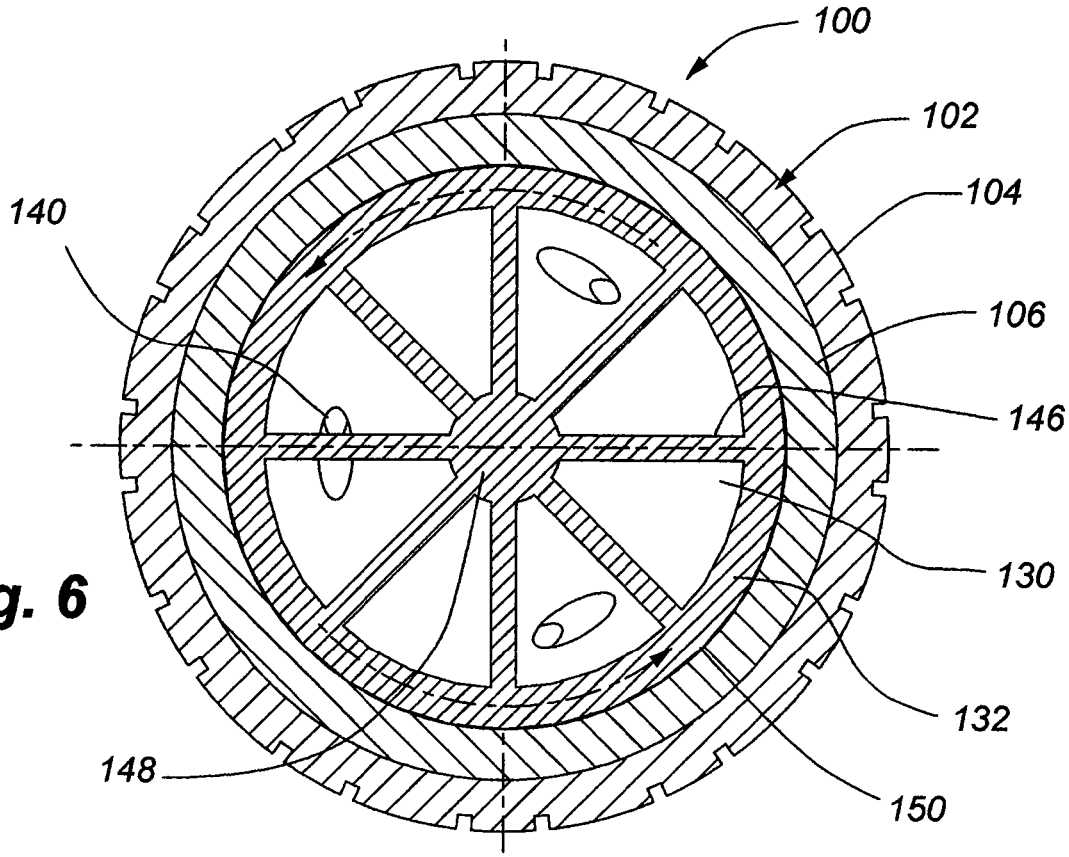
FIG. 6 depicts another cross-section view of the showerhead shown in FIG. 1, viewed along line 6-6 in FIG. 3.
Figure 7:
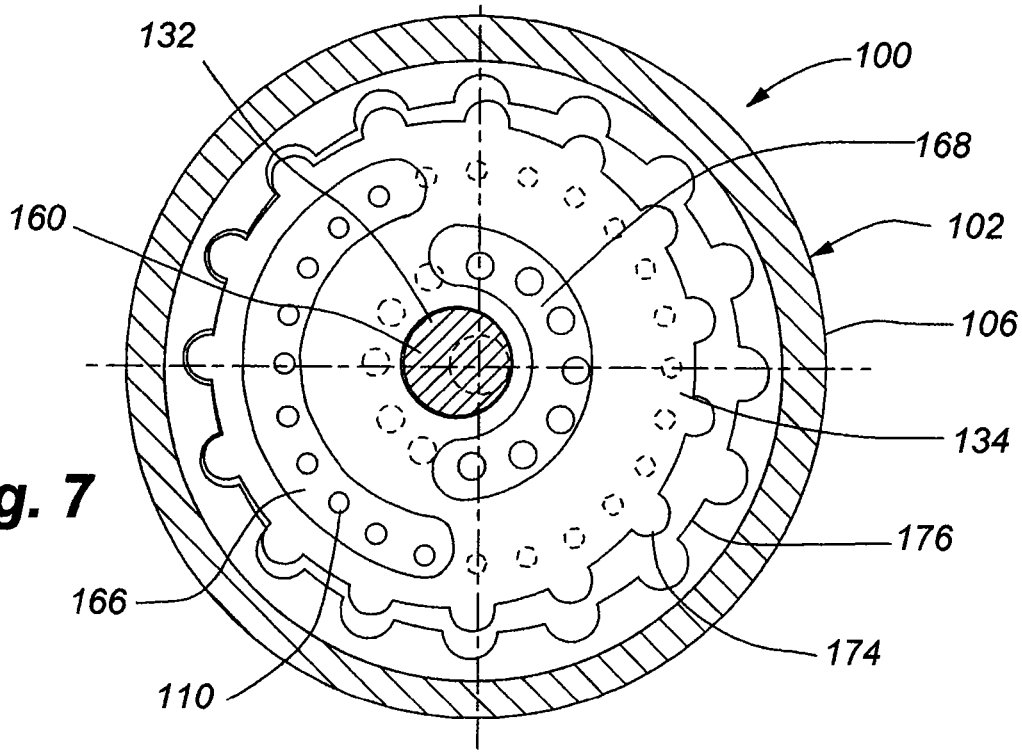
FIG. 7 depicts yet another cross-section view of the showerhead shown in FIG. 1, viewed along line 7-7 in FIG. 3.

Operation of the showerhead 100 will now be described with reference to FIGS. 3, 6 and 7. Water or other fluid may flow through the fluid inlet from the fluid source to the jet disk 130. As water or other fluid passes through the jets 140, it impacts one or more blades 146 of the turbine 132, which is situated within the housing 102 between the shutter 134 and the jet disk 130. Water impacting the turbine blades 146 imparts rotational motion to the turbine 132. As viewed from the side of the turbine 132 facing the shutter 134 as shown, for example, in FIG. 6, the turbine 132 may rotate in a clockwise fashion. Alternative embodiments may cause the turbine 132 to rotate in a counterclockwise fashion. After impacting the turbine blades 146, the water hits the upper side 170 of the shutter 134.

As the turbine 132 rotates from water impacting its blades 146, the turbine 132 causes the center of the shutter 134 to move in a generally circular motion via the aforementioned connection between the shutter 134 and the turbine's eccentric cam 160. This meshes at least some of the external teeth of the shutter 134 with some of the internal teeth of the housing 102 resulting in rotational movement of the shutter 134 relative to the turbine 132. Additionally, the teeth of the shutter 134 and housing 102 disengage at a side of the shutter 134 approximately opposite the point of engagement as shown, for example, in FIG. 7 and FIGS. 12-15.

Since the shutter 134 has one less tooth than the housing 102 and tooth disengagement between the shutter 134 and the housing 102 is made possible by motion of the center of the shutter 134 in a generally circular path around the central axis of the turbine 132, each complete revolution of the turbine 132 results in a one tooth displacement of the shutter 134 in relation to the housing 102. This displacement is in the opposite direction of the rotation of the turbine 132. For example, if the turbine 132 is rotating in a clockwise direction, the one tooth displacement of the shutter 134 relative to the housing 102 will be in a counterclockwise direction and vice versa. This selective engagement of the shutter teeth with the housing teeth functions as a speed reduction mechanism because the shutter 134 rotates $1/15$th as quickly as it would absent this engagement. Thus, the combination of the turbine 132, the cam 160, the shutter 134 and the housing 102 operate together as a cycloidal drive to achieve a rotational speed reduction from the turbine 132 to the shutter 134.

The speed reduction achieved (i.e., how fast the shutter 134 rotates relative to how fast the turbine 132 rotates) is determined by the ratio of the difference between number of engagement features 176 of the housing 102 and the number of engagement features 174 on the shutter 134 to the number of engagement features 174 on the shutter 134. For the showerhead depicted in FIGS. 1-15, a speed reduction of $1/15^{th}$ occurs since the housing 102 has sixteen gear teeth and the shutter 134 has fifteen gear teeth. That is, the shutter 134 rotates at $1/15^{th}$ the rotational speed of the turbine 132.

Figure 16:
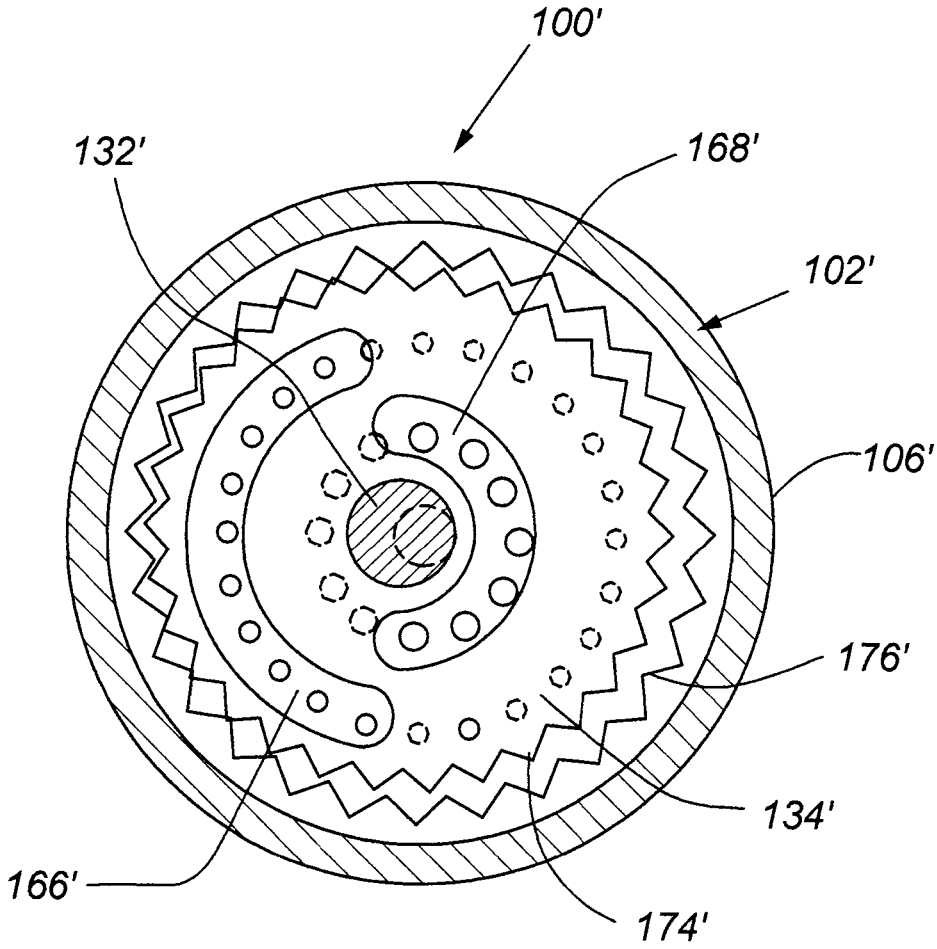
FIG. 16 depicts a cross-section view of an alternate embodiment, similar to the view shown in the embodiment of FIG. 7, depicting a precessing shutter with more engagement features on the shutter than on the housing.

In other embodiments, the shutter may have 30 gear teeth and the housing may have 31 gear teeth. This causes the shutter to turn in the opposite direction of the turbine by $1/30^{th}$ of the rotational rate of the turbine. In other words, the shutter rotates approximately $1/30^{th}$ about its central axis each time the turbine completes one revolution, and the shutter rotates in the opposite direction of the turbine. Accordingly, the shutter completes a complete revolution in the opposite direction of the turbine each time the turbine completes 30 revolutions. In yet other embodiments of a showerhead 100', for example, in FIG. 16, the shutter 134' may have more engagement teeth than the housing 102', which causes the shutter 134' to rotate in the same direction as the turbine 132', albeit at a slower rate. For example, the embodiment of FIG. 16 uses a shutter 134' with 30 engagement features 174' (i.e., gear teeth) and a housing 102' with 28 engagement features 176 (i.e., housing teeth). This causes the shutter 134' to precess, i.e., turn in the same direction as the turbine 132', at a rate of $1/14^{th}$ the speed of the turbine 132'. Other embodiments may employ a shutter and a housing with more or fewer teeth to achieve a desired speed reduction and direction of rotation of the shutter relative to the rotational speed and direction of rotation of the turbine.

Referring to FIGS. 8-12, as the shutter 134 rotates inside the housing 102 within the recessed area defined by the housing engagement feature 176, one or more shutter fluid openings 166, 168 in the shutter 134 pass over rows of outlets 110 arranged in the recessed area defined by housing engagement feature 176. In this manner, water may temporarily flow through the unobstructed outlets 110 located under the shutter fluid openings 166, 168. Thus, as the shutter 134 rotates, water flow through the outlets 110 is periodically interrupted as the solid portion of the shutter 134 temporarily obstructs water flow through outlets 110 located under the solid portion of the shutter 134 as depicted, for example, in FIGS. 8-12. This creates a pulsating flow of water from the showerhead 100. The period of the pulsating flow is determined, in part, by the rotational speed of the shutter 134 as further explained below.

Figure 8:
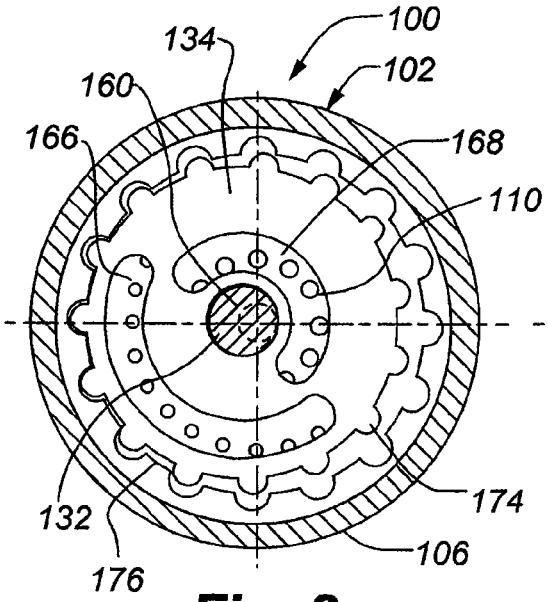
FIG. 8 depicts still yet another cross-section view of the showerhead shown in FIG. 1, showing a view similar to the view shown in FIG. 7.
Figure 9:
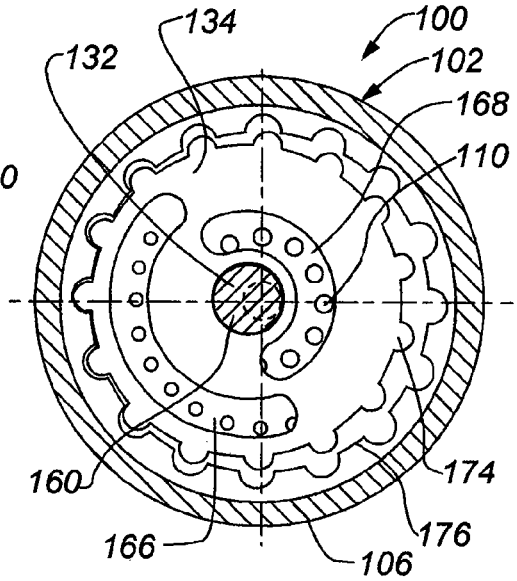
FIG. 9 depicts a cross-section view of the showerhead shown in FIG. 1 similar to the view shown in FIG. 8, showing the position of the shutter openings relative to the showerhead outlets after the turbine has moved one complete revolution from the position shown in FIG. 8.
Figure 10:
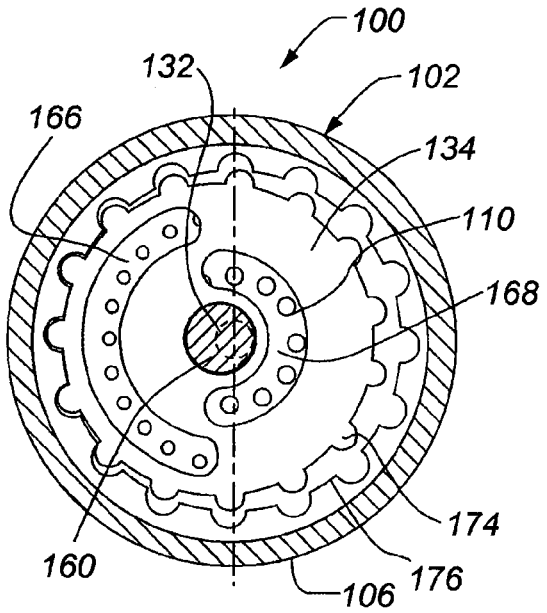
FIG. 10 depicts a cross-section view of the showerhead shown in FIG. 1 similar to the view shown in FIG. 8, showing the position of the shutter openings relative to the showerhead outlets after the turbine has moved two complete revolutions from the position shown in FIG. 8.
Figure 11:
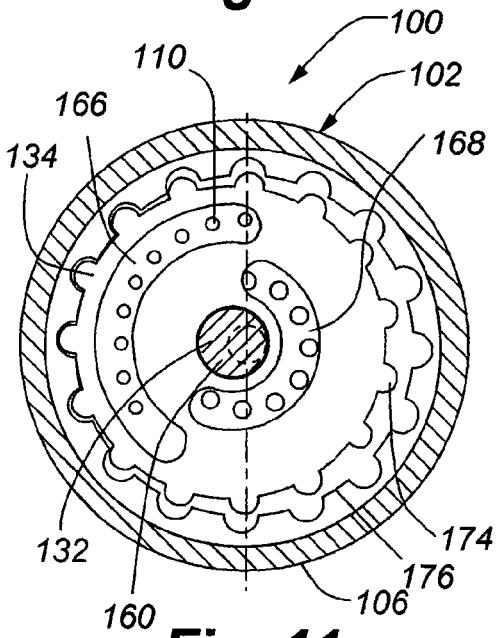
FIG. 11 depicts a cross-section view of the showerhead shown in FIG. 1 similar to the view shown in FIG. 8, showing the position of the shutter openings relative to the showerhead outlets after the turbine has moved three complete revolutions from the position shown in FIG. 8.
Figure 12:
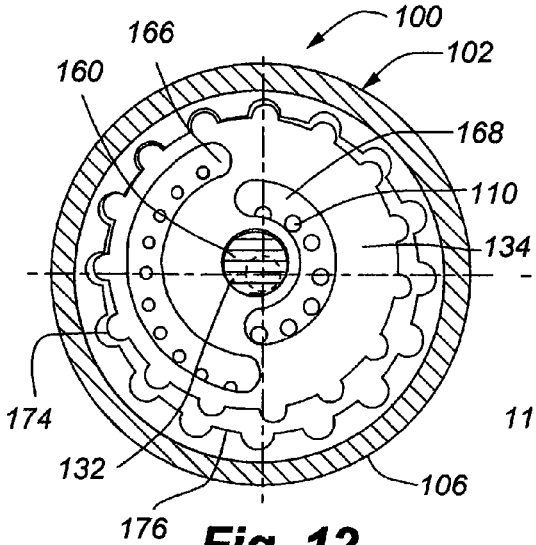
FIG. 12 depicts yet a further cross-section view of the showerhead shown in FIG. 1, showing a view similar to the view shown in FIG. 7 and showing the cam in a first position.
Figure 13:
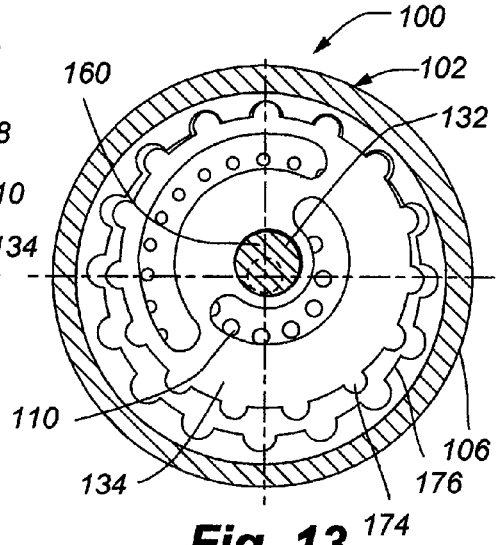
FIG. 13 depicts a cross-section view of the showerhead shown in FIG. 1 similar to the view shown in FIG. 12, showing the cam in a second position and the relationship of the perimeter of the shutter to the housing when the cam is in the second position.
Figure 14:
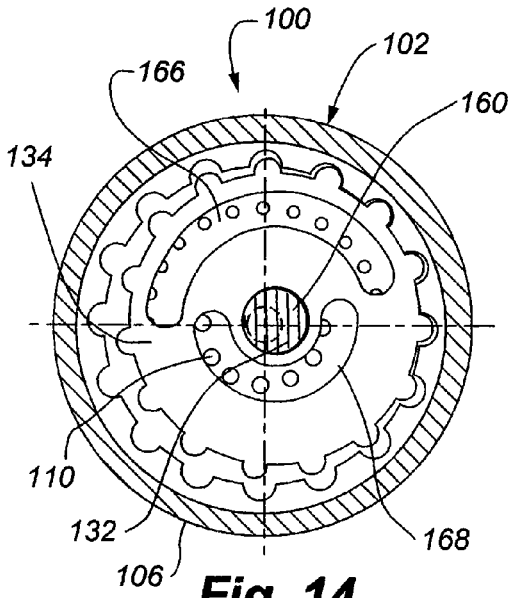
FIG. 14 depicts a cross-section view of the showerhead shown in FIG. 1 similar to the view shown in FIG. 12, showing the cam in a third position and the relationship of the perimeter of the shutter to the housing when the cam is in the third position.
Figure 15:
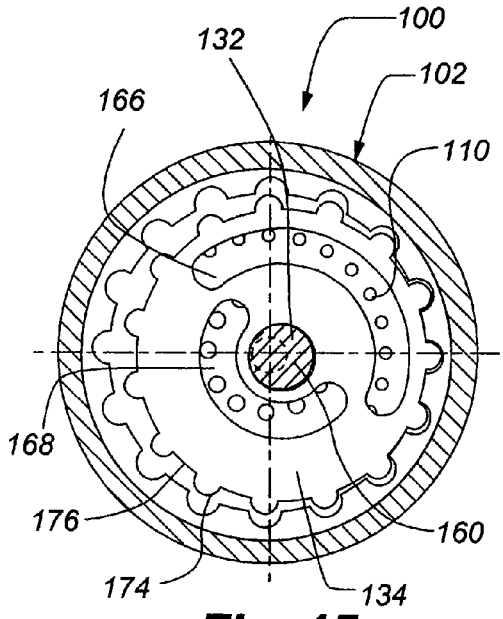
FIG. 15 depicts a cross-section view of the showerhead shown in FIG. 1 similar to the view shown in FIG. 12, showing the cam in a fourth position and the relationship of the perimeter of the shutter to the housing when the cam is in the fourth position.

FIG. 9 generally depicts the shutter 134 rotated clockwise within the housing 102 from the relative position occupied in FIG. 8 after the turbine 132 has completed one complete revolution in a counterclockwise direction. FIG. 10 generally depicts the shutter 134 rotated clockwise within the housing 102 from the relative position occupied in FIG. 8 after the turbine 132 has completed two complete revolutions in a counter-clockwise direction. FIG. 11 generally depicts the shutter 134 rotated clockwise within the housing 102 from the relative position occupied in FIG. 8 after the turbine 132 has completed three complete revolutions in a counter-clockwise direction.

With reference to FIGS. 8-12, the shutter 134 may have inner and outer fluid openings 166, 168 that each extend about half way around the shutter 134. The inner and outer fluid openings 166, 168 may generally be formed on opposing halves of the shutter 134. The housing 102 also may include an inner and outer circular row of outlets 110. The inner fluid opening 168 of the shutter may overlap at least part of the inner circular row of outlets 110, while the outer fluid opening 166 may overlap at least part of the outer circular row of outlets 110. When the shutter fluid openings 166, 168 are positioned over certain outlets 110, water flows through these unobstructed outlets 110 to exit the showerhead 100. When an outlet 110 is not aligned with at least one of the shutter fluid openings 166, 168, water flow is blocked through that outlet 110. Thus, as the shutter 134 rotates, water flow through the outlets 110 may be interrupted in a sequence. This may, for example, produce a relatively low-speed, periodic interruption of water flow through each row of outlets 110.

As previously discussed, for the embodiment depicted in FIGS. 1-15, there are 15 gear teeth on the shutter 134 and 16 gear teeth in the housing 102 causing the shutter 134 to rotate in a direction opposite the turbine 132 at a rate $1/15^{th}$ that of the turbine 132. The period of the pulsating flow of water through an outlet 110 is a direct multiple of the speed reduction times the turbine speed. Thus, if water flow through the showerhead 100 causes the turbine 132 to spin at 60 revolutions per second, the shutter 134 will rotate at a rate of 4 revolutions per second. This results in a period of the pulsating flow through an outlet 110 of about 0.25 seconds, which may simulate the feel of a hand massage. As yet another example, if the turbine 132 rotates at 50 revolutions per seconds and the speed reduction is $1/10^{th}$, the shutter 134 will rotate at a rate of five revolutions per second. This results in a period of the pulsating flow through an outlet 110 of about 0.20 seconds. The foregoing examples are merely illustrative and are not intended to imply or require a particular speed reduction, turbine speed, or pulse time.

The aforementioned pulse time represents the period of time for one complete cycle of flow through an outlet 110. In other words, the time it takes for water to start flowing through an outlet 110, stop flowing through the outlet 110, and then start flowing again through the outlet 110. The ratio of the amount of time that water flows and does not flow through an outlet during a single cycle is a function of the length of the shutter fluid opening. As the length of the shutter fluid opening increases, the ratio of the time water flows through the associated outlet 110 to the time it does not flow through the outlet 110 increases. For example, if a shutter fluid opening has a length that extends approximately one-half of the circumference of the shutter 134 as shown, for example, in FIGS. 7-15, the ratio of the time water flows through an outlet 110 to not flowing through the outlet 110 will be approximately 1:1. As another example, if a shutter fluid opening has a length that extends approximately one-quarter of the circumference of the shutter 134, the ratio of the time water flows through an outlet 110 to not flowing through the outlet 110 will be approximately 1:3. The foregoing examples are merely illustrative and are not intended to imply any particular length or ratio of flow time during a single cycle for a showerhead.

FIGS. 16-25 depict various views of a second embodiment of a showerhead 200. The second showerhead 200 is similar in structure and operation to the first showerhead 100 and like numbers for the second showerhead 200 may be used for similar or like elements of the first showerhead 100. Like the first showerhead 100, the second showerhead 200 may include a turbine 132, a jet disk 130, a shutter 134, and a housing 102. In this particular embodiment, the shutter 134 may include one fluid opening 202 that extends about two-thirds the way around the shutter 134, as shown, for example, in FIGS. 19-20. The showerhead 200 may also include one or more seal members 136, 138, such as a fluid inlet seal member 136 and housing seal member 138 as shown, for example, in FIGS. 18-20. The fluid inlet seal member 136 and the housing seal member 138 may be similar to the corresponding seal members 136, 138 described for the first showerhead 100.

Figure 18:
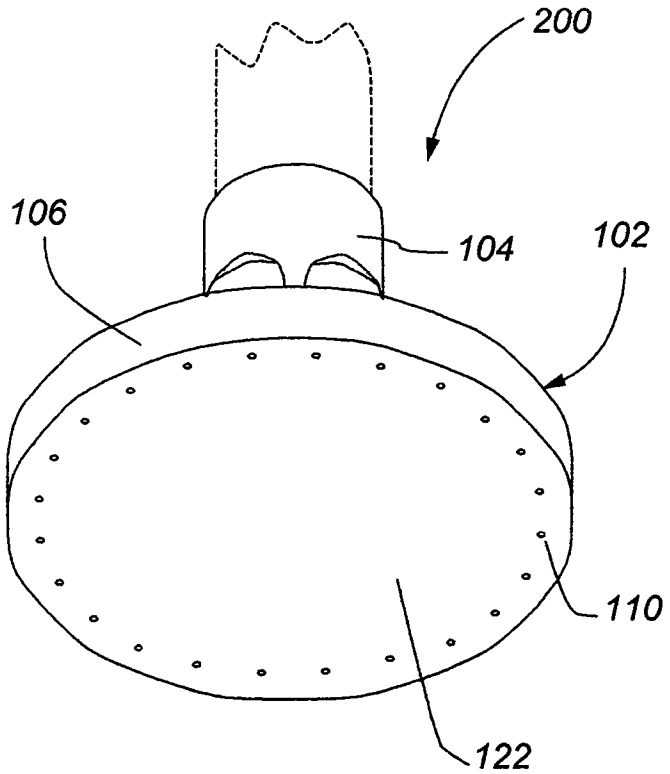
FIG. 18 depicts a front isometric view of the showerhead shown in FIG. 17.
Figure 17:
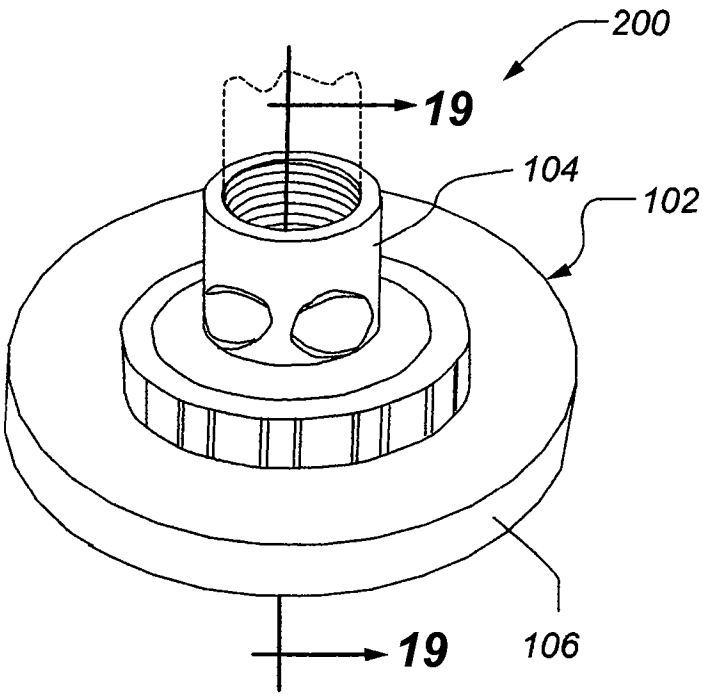
FIG. 17 depicts a rear isometric view of a second embodiment of a showerhead.
Figure 19:
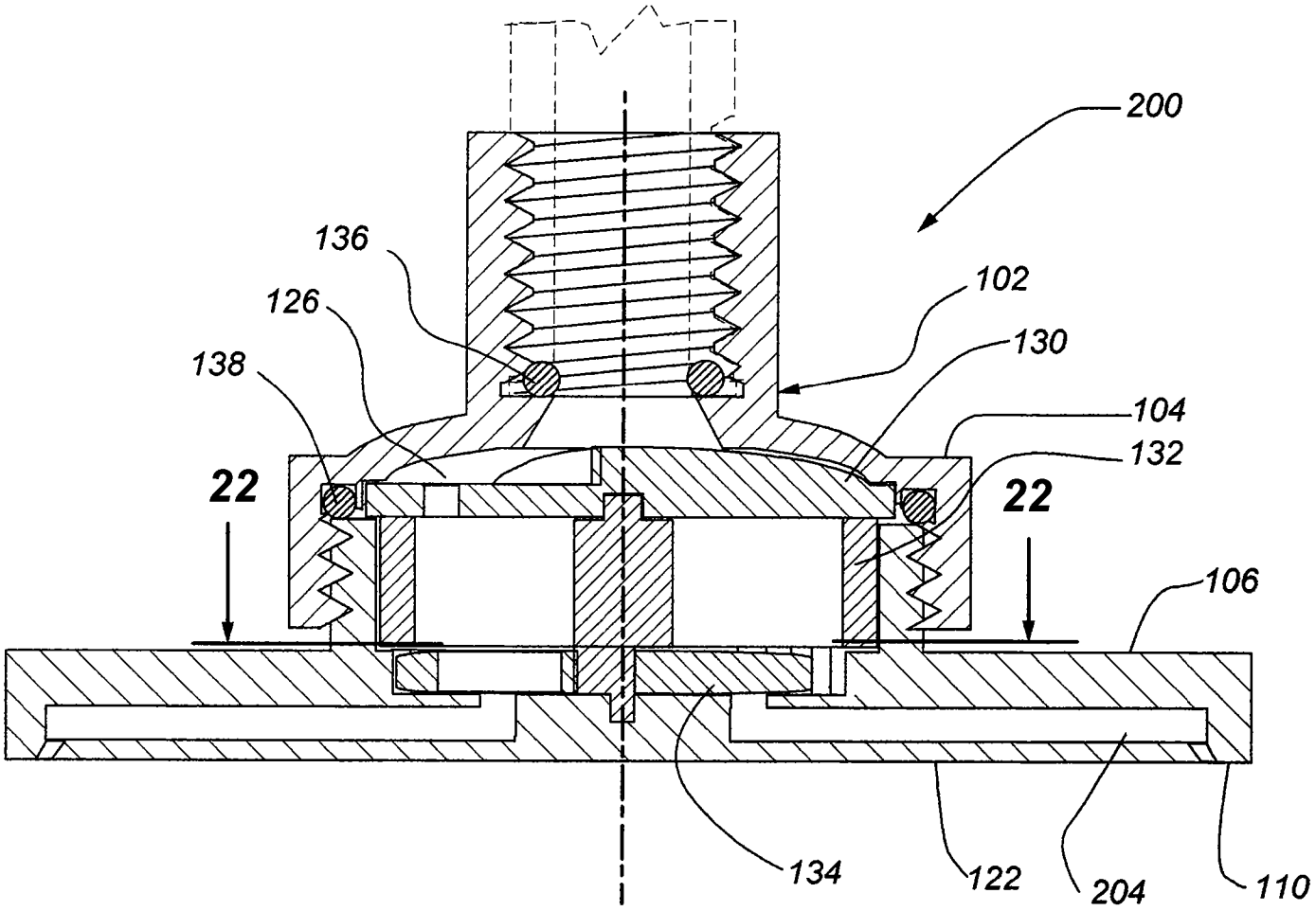
FIG. 19 depicts a cross-section view of the showerhead shown in FIG. 17, viewed along line 19-19 in FIG. 17.
Figure 20:
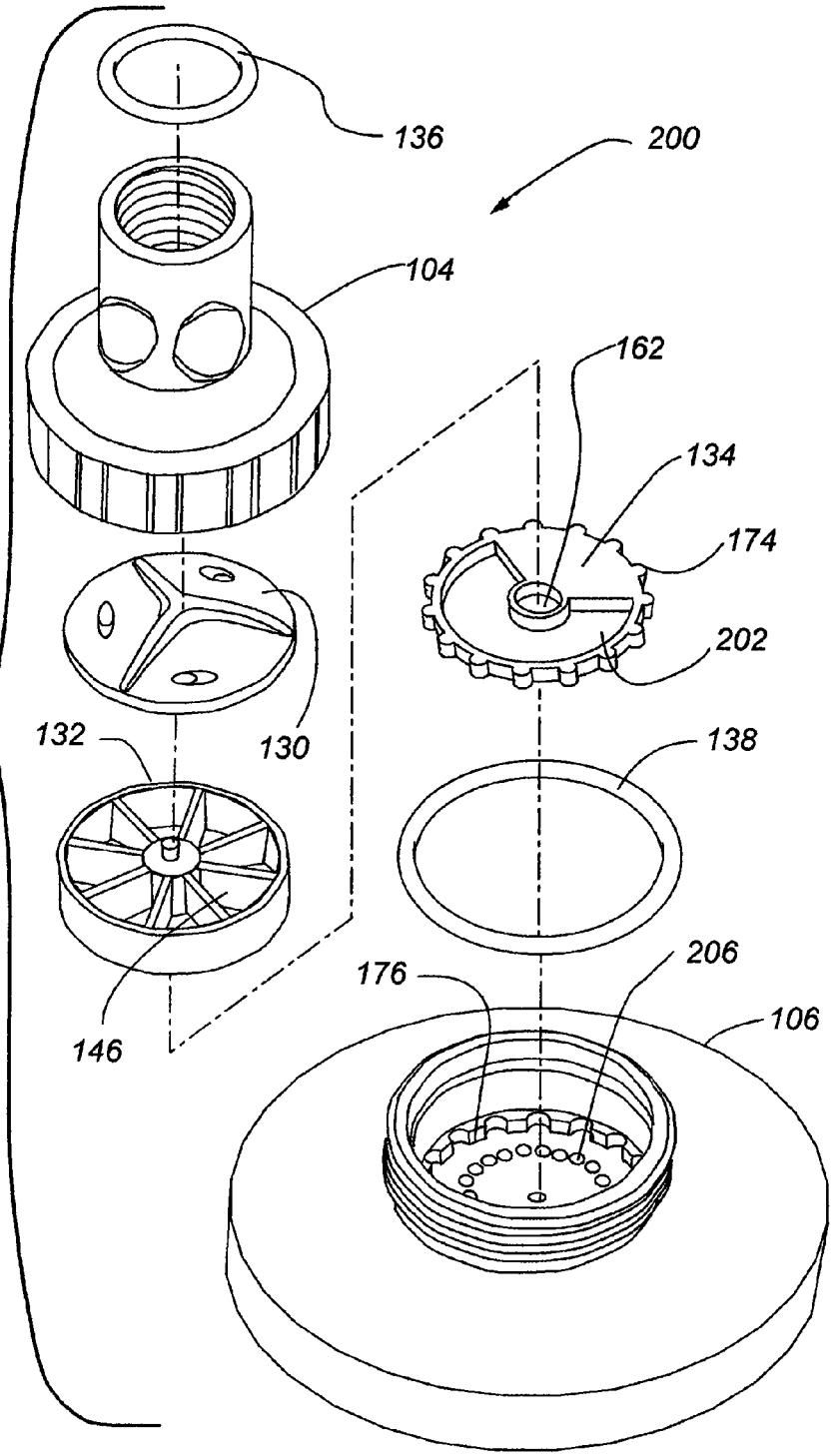
FIG. 20 depicts an exploded top isometric view of the showerhead shown in FIG. 17.

Like the first embodiment, the housing 102 for the second showerhead 200 may include upper and lower housing portions 104, 106 threadedly joined as shown, for example, in FIG. 18, or joined by any other known connection method or combination thereof. Also, like the housing 102 for the first showerhead 100, the housing 102 for the second showerhead 200, although shown as having a particular shape in the figures, may be formed into any desired shape and may be formed from any desired number of portions or components. The housing 102 may include one row of outlets or nozzles 110 as shown in FIG. 20, which may be fluidly connected to the housing chamber or cavity 126 via fluid passages or conduits 204 defined in a base 122 of the lower housing portion 106, as shown, for example, in FIGS. 18 and 19. The base 122 may be formed as a separate layer below or formed from a recessed area of the upper surface 222 of the lower housing portion 106. A recessed area may be defined by the housing engagement feature 176 having a circular-shaped recessed area with depressions having a complementary shape to the engagement feature of shutter 134. Each fluid passage 204, in turn, may include a fluid passage opening 206, shown in FIG. 23, defined in the upper surface 222 of the lower housing portion 106, e.g., in the recessed area formed by the housing engagement feature 176, for fluidly joining the fluid passages 204 to the housing chamber or cavity 126. As with the previous embodiment, the turbine 132, shown in FIG. 25, may take the form of a generally hollow open-ended cylinder with blades extending radially inward toward a central hub from a generally circular turbine wall. For a given sized turbine 132 and/or chamber 126, the fluid passages 204 allow for the use of a larger showerhead 200 to create a larger diameter spray pattern from the showerhead 200.

Figure 24:
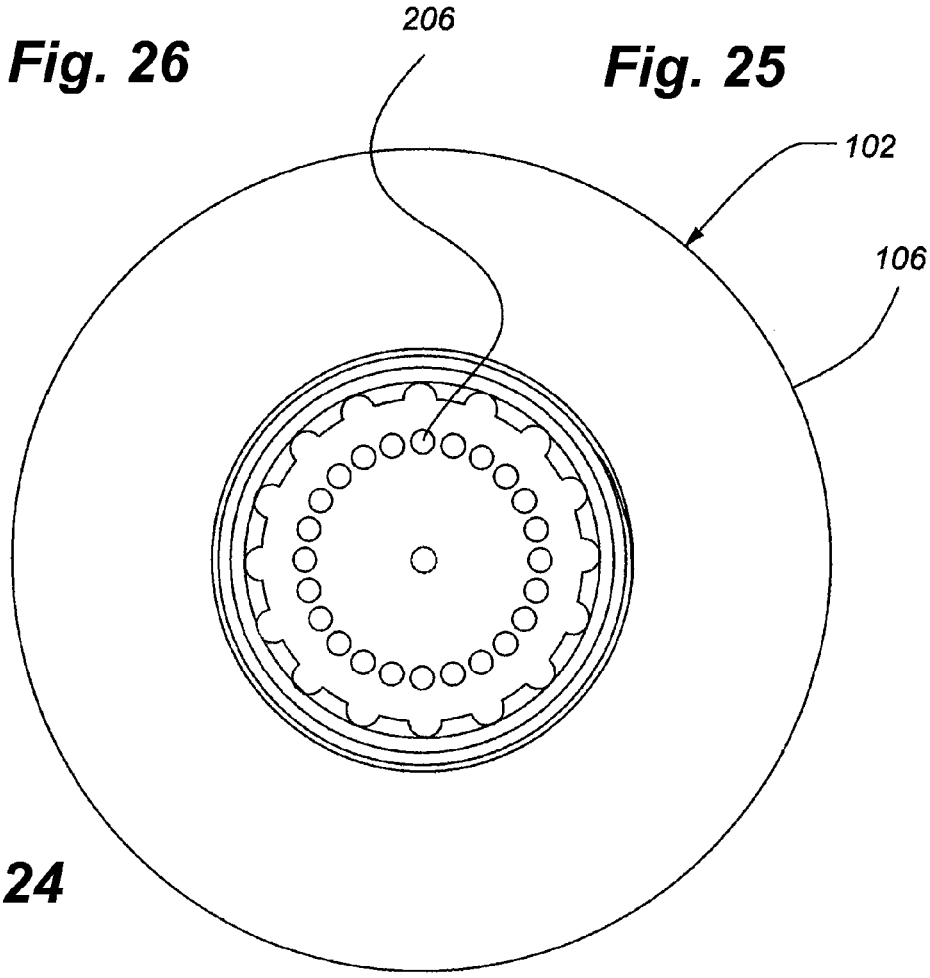
FIG. 24 depicts a top plan view of the lower housing for the showerhead of FIG. 20.

Like the shutter 134 for the first showerhead 100, the shutter 134 for the second showerhead 200, shown in FIG. 24, may include a generally circular and planar (or any other shaped) body including at least one shutter fluid opening 202. Also, like the shutter 134 for the first showerhead 100, the shutter 134 for the second showerhead 200 may include a cam opening 162 along its central axis for receiving an eccentric cam 160 formed on the turbine 132. The shutter 134 may thus spin or rotate about the central axis of the eccentric cam 160 as the turbine 132 rotates in a manner similar to the shutter 134 for the first showerhead 100. As the turbine 132 spins, the motion of the eccentric cam 160 causes the shutter 134 to rotate about the center of the eccentric cam 160 such that the portions of the shutters periphery that contacts the housing 102 changes as described in more detail above for the first showerhead 100.

Figure 21:
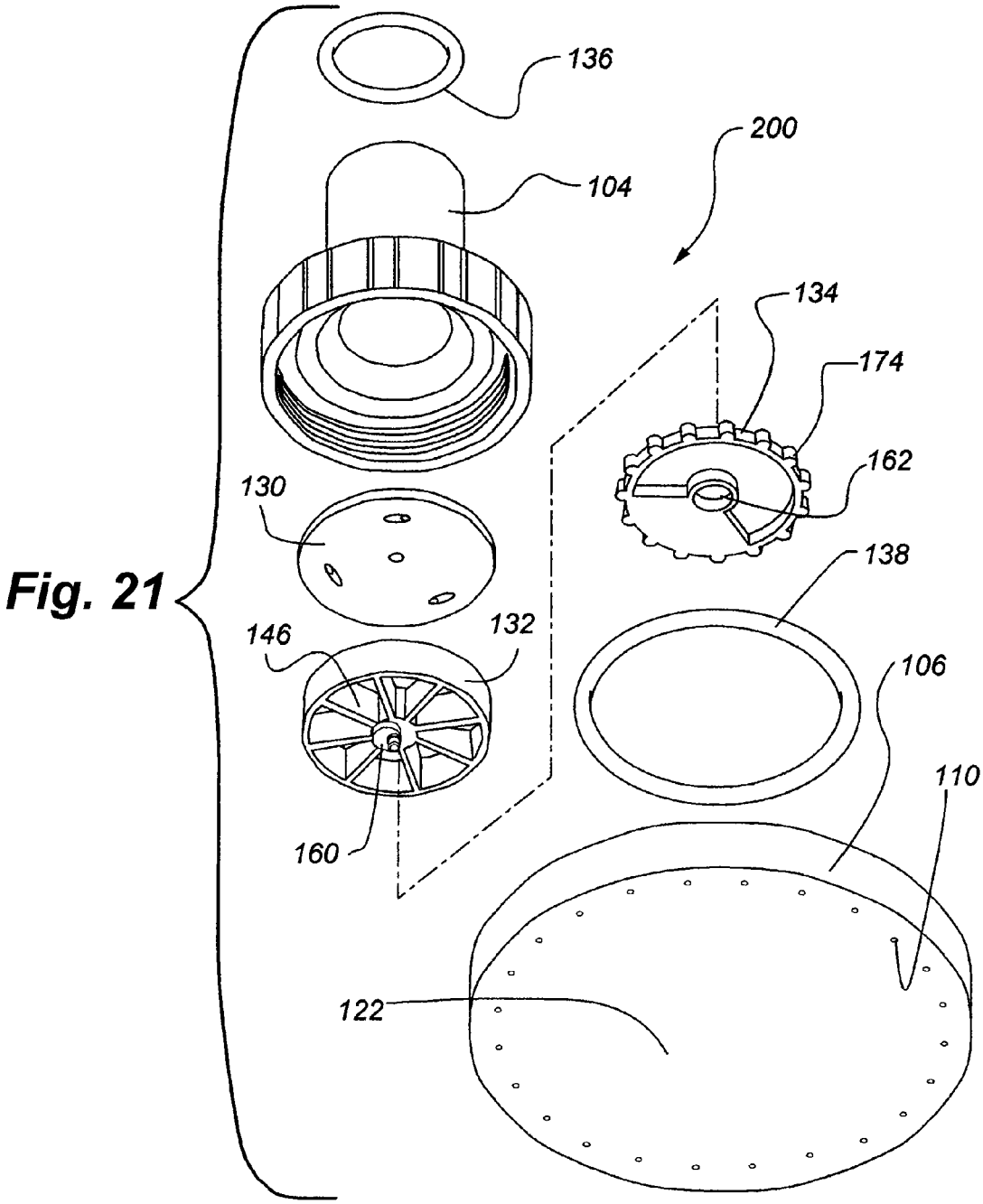
FIG. 21 depicts an exploded bottom isometric view of the showerhead shown in FIG. 17.
Figure 22:
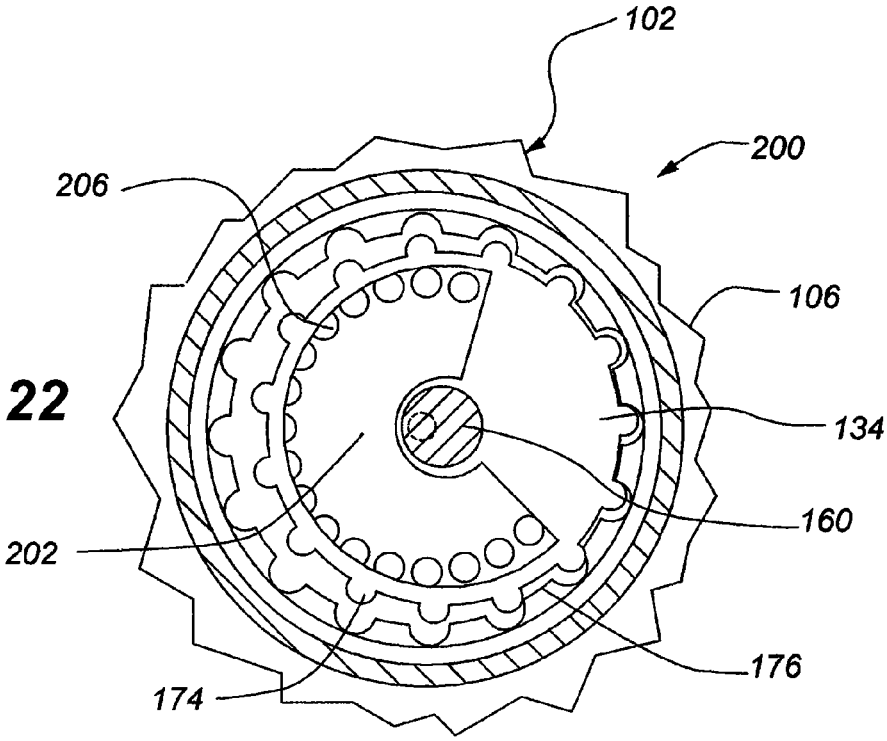
FIG. 22 depicts another cross-section view of the showerhead shown in FIG. 16, viewed along line 22-22 in FIG. 19.
Figure 23:
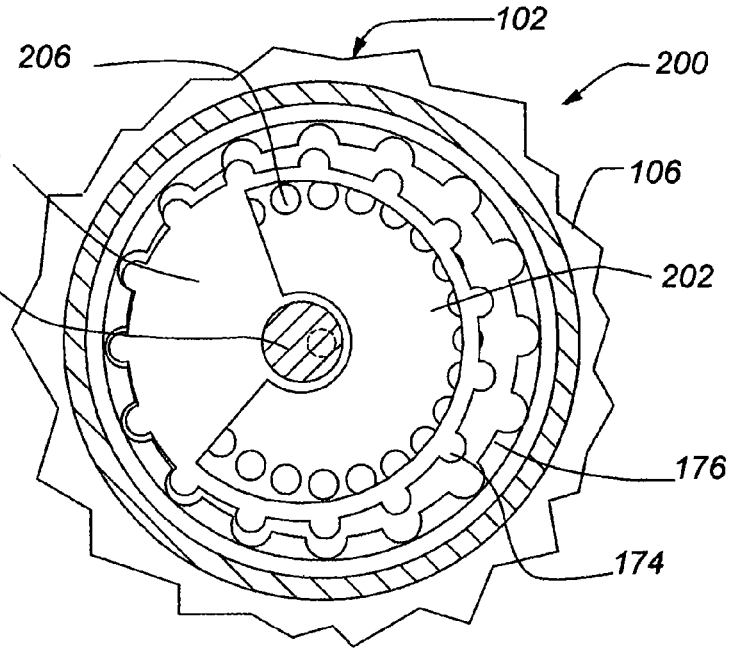
FIG. 23 depicts a cross-section view of the showerhead shown in FIG. 17 similar to the view shown in FIG. 22, showing the position of the shutter opening relative to the housing after rotation of the shutter within the housing.

The shutter 134 and housing 102 may each include one or more gear teeth, as described above. For example, and as illustrated in FIGS. 21 and 22, the shutter 134 may have 15 gear teeth and the housing may have 16 gear teeth that engage the shutter teeth. Accordingly, the shutter 134 rotates inside the housing 102 in an opposite direction with respect to the turbine 132 at a rate $1/15^{th}$ the speed of the turbine 132. FIG. 22 generally depicts the shutter 134 rotated clockwise within the housing 102 from its position in FIG. 21.

As depicted in FIGS. 21 and 22, as the shutter 134 rotates over the upper surface 222, e.g., within the recessed area defined by the housing engagement feature 176, the flow of water through the fluid passage openings 206, and thus the outlets 110 arranged in the base 122 and in the recessed area in fluid communication with respective fluid passage opening 206, is interrupted as the solid portion of the shutter 134 passes over a fluid passage openings 206. When the shutter fluid opening 202 is over a fluid passage opening 206, water flows through the associated fluid passage 204 and exits the showerhead 200 through the outlet 110 associated with the fluid passage 204. When a fluid passage opening 206 is not aligned with the shutter fluid opening 202, water flow ceases through the outlet 110 in fluid communication with the fluid passage opening 206. Thus, as the shutter 134 rotates, water flow through the outlets 110 may be interrupted in a sequence. This may, for example, produce a relatively low-speed, periodic interruption of water flow through each outlet 110. Other embodiments may employ more or fewer rows of outlets 110 in the housing 102 and may employ more or fewer shutter fluid openings 202 to create a variety of low speed pulsating water flow patterns. For example, multiple shutter fluid openings 202 may be radially aligned with one another to produce a spray pattern. As another example, the outlets 110 may be grouped within one or more sectors on the housing base 122 and/or spaced non-uniformly within one or more rows.

Water flow through the second showerhead 200, at least to the bottom side of the shutter 134, generally proceeds as previously described above for the first showerhead 100. Also as previously described above for the first showerhead 100, selective engagement of the shutter engagement feature 174 with the housing engagement feature 176, which is defined by a circular-shaped recessed area with depressions having a complementary shape to the shutter engagement feature 174 in an upper surface 222 of the lower housing 106 causes the shutter 134 to rotate at a slower speed than the turbine 132. As the shutter 134 rotates inside the chamber 126 of the housing 102, one or more shutter fluid openings 202 may pass over one or more rows of fluid passage openings 206 in the lower housing 106. This permits water to temporarily flow through the unobstructed fluid passage openings 206. Thus, as the shutter 134 rotates, water flow through the outlets or nozzles 110 is periodically interrupted as the solid portion of the shutter 134 temporarily obstructs the water flow through those outlets 110 in fluid communication with fluid passage openings 206 located under the solid portion of the shutter 134. This creates a pulsating flow of water from the showerhead 200.

Various embodiments of the second showerhead 200 may use the same or differing numbers of fluid passage openings 206 to outlets or nozzles 110. For example, each outlet 110 may be in fluid communication with a single fluid passage opening 206, or an outlet 110 may be in fluid communication with two or more fluid passage openings 206, or vice versa.

Figure 26:
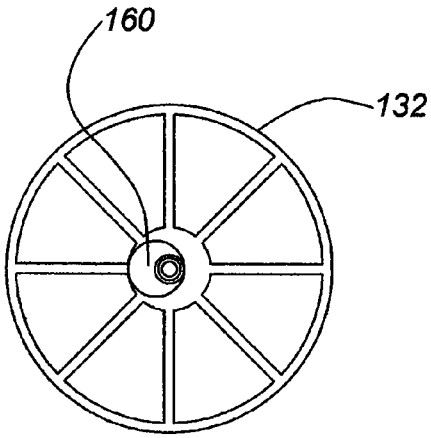
FIG. 26 depicts a bottom plan view of the turbine for the showerhead shown in FIG. 17.
Figure 25:
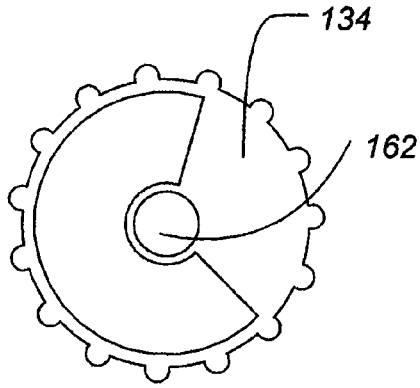
FIG. 25 depicts a top plan view of the shutter for the showerhead of FIG. 17.
Figure 27:
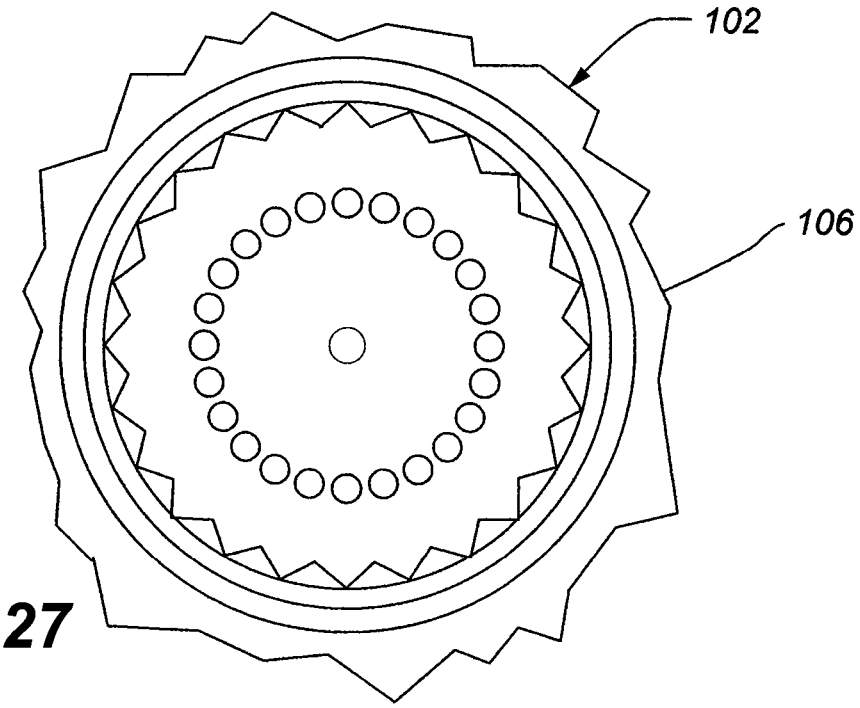
FIG. 27 depicts a top plan view of another embodiment of a lower housing for the showerhead shown in FIG. 17.
Figure 28:
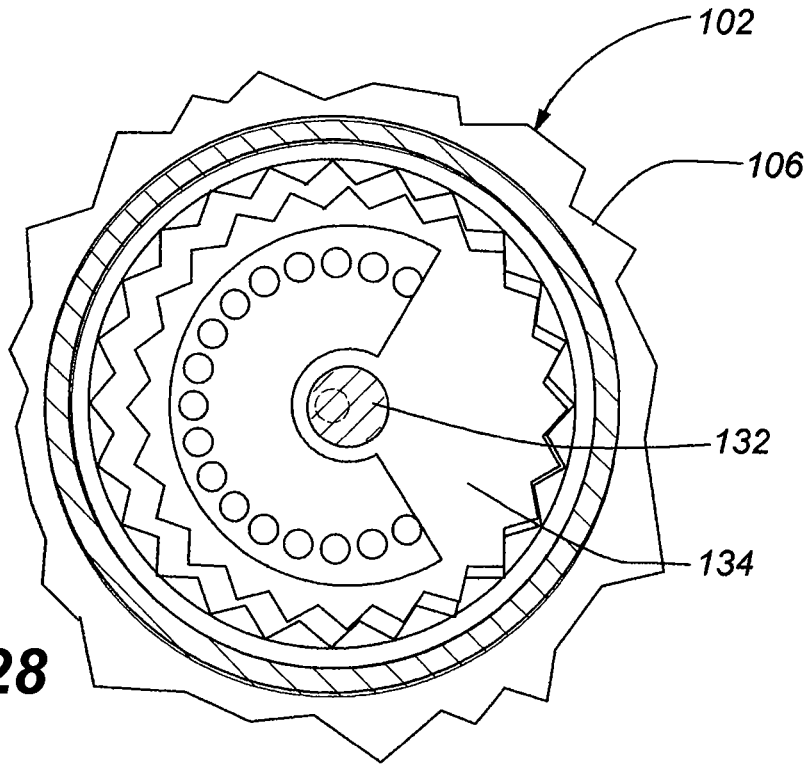
FIG. 28 depicts a cross-section view of an alternate embodiment of the showerhead of FIG. 17, similar to the view shown in FIG. 19, showing an alternate shutter positioned within the lower housing of FIG. 27.

Other embodiments of the showerhead, including variations of the first and second showerheads 100, 200, may use other types of engageable features on the shutter 134 and the housing 102 to cause the shutter 134 to rotate at a different rate than the turbine 132. For example, the shutter 134 may have external, involute teeth and the housing 102 may have matching internal, involute housing teeth. As another example, the shutter 134 may have sawtooth features that mate to sawtooth cuts in the housing 102 as depicted in FIGS. 26 and 27. In yet another example, pins extending radially from the periphery of the shutter 134 may mate with slots in the housing 102. As yet another example, slots in the shutter 134 may mate with pins extending radially inward from the housing 102. As still yet another example, circular cuts in the periphery of the shutter 134 may engage pins in the housing 102. The foregoing examples are merely illustrative and are not intended to limit the engageable features for the shutter 134 and/or the housing 102 to any particular feature, or to limit other mechanisms for causing the shutter 134 to rotate at different rate than the turbine 132.

Further, the engagement of the shutter 134 to the housing 102 is generally not limited to the use of engagement features 174, 176 to implement the speed reduction mechanism or to otherwise change the rotational speed of the shutter 134 relative to the turbine 132. In some embodiments, the shutter 134 may be made to lag the turbine 132 through frictional engagement between the shutter 134 and housing 102. In such embodiments, the speed reduction may be determined by the ratio of the difference in the diameters of the housing 102 and the shutter 134, divided by the diameter of the shutter 134 (presuming minimal to no slippage between the shutter 134 and the housing 102).

FIGS. 28-31 depict various views of an alternative embodiment of a lower housing 106 and a shutter 134 for use with either or both of the showerheads 100, 200. For purposes of simplification, elements of the showerhead other than the lower housing 106 and the shutter 134 are not depicted in FIGS. 28-31. It is to be appreciated that the omitted elements may be configured substantially identically to the same components of showerheads of previous embodiments.

Figure 29:
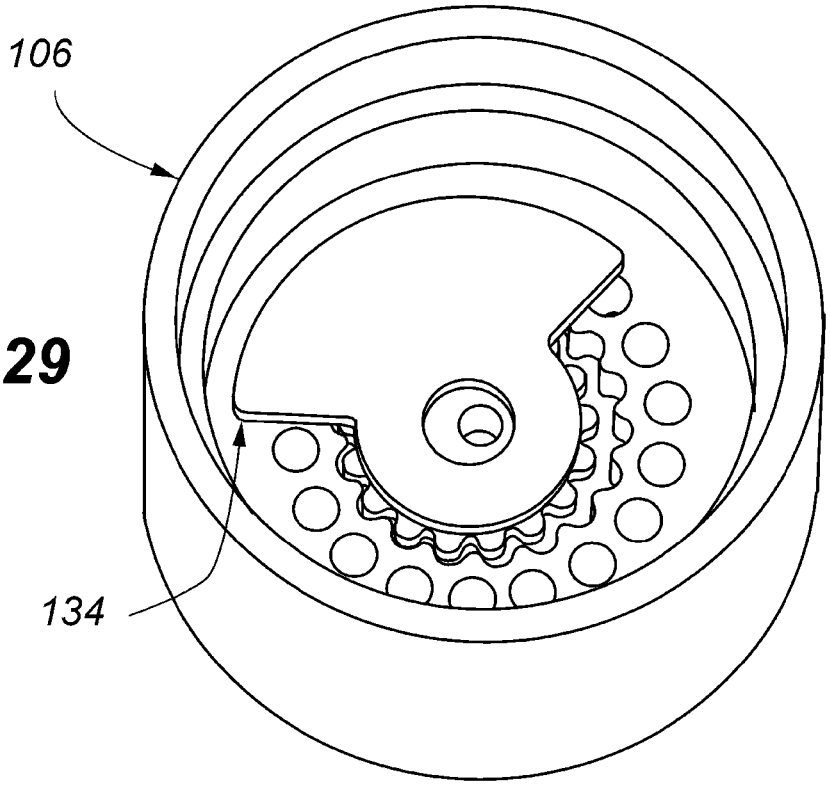
FIG. 29 depicts a top isometric view of a lower housing portion and a shutter in accordance with an alternative embodiment of a low-speed pulsating showerhead.

Referring to FIG. 29, in the present embodiment the one or more fluid passage openings 206 and an annular recess 226 may be defined in the upper surface 222 of the lower housing portion 106. The annular recess 226 may be defined by an outer sidewall 224 and an inner sidewall 225, the inner sidewall 225 defining a periphery of a pin receiving member 227. The pin receiving member 227 may define the opening 156 for receiving the lower pin-shaped extrusion 154. The annular recess 226 may be sized and shaped to accommodate a complementary portion of the shutter 134.

In the present embodiment, the engagement features 176 of the lower housing portion 106 may define the annular recess 226 and be positioned radially inward with respect to the fluid passage openings 206. For example, the engagement features 176 may be provided on the outer sidewall 224. The positioning of the engagement features 176 of the present embodiment relative to the fluid passage openings 206 is in contrast to that of previous embodiments in which the engagement features 176 are positioned radially outward relative to the fluid passages 206 resulting in the fluid passages 206 being arranged within the recessed area defined by the engagement features. Thus, in this embodiment, the fluid passage openings are defined in the upper surface 222 of the lower housing 106, but are not within the annular recess 226.

Configuring the engagement features 176 in the manner of the present embodiment, for example, provides a more compact showerhead as well as a more efficient use space within the cavity 126 formed by the upper and lower housing portions 104, 106. As with previous embodiments, the engagement features 176 may be formed as engaging teeth for engaging complementary gear teeth of the shutter 134. As also with previous embodiments, the lower housing portion 106 may further include suitable engagement features to facilitate joining of the lower housing portion 106 to the upper housing portion 104 such as, for example, threads configured to engage complementary threads of the upper housing portion 104.

Figure 30:
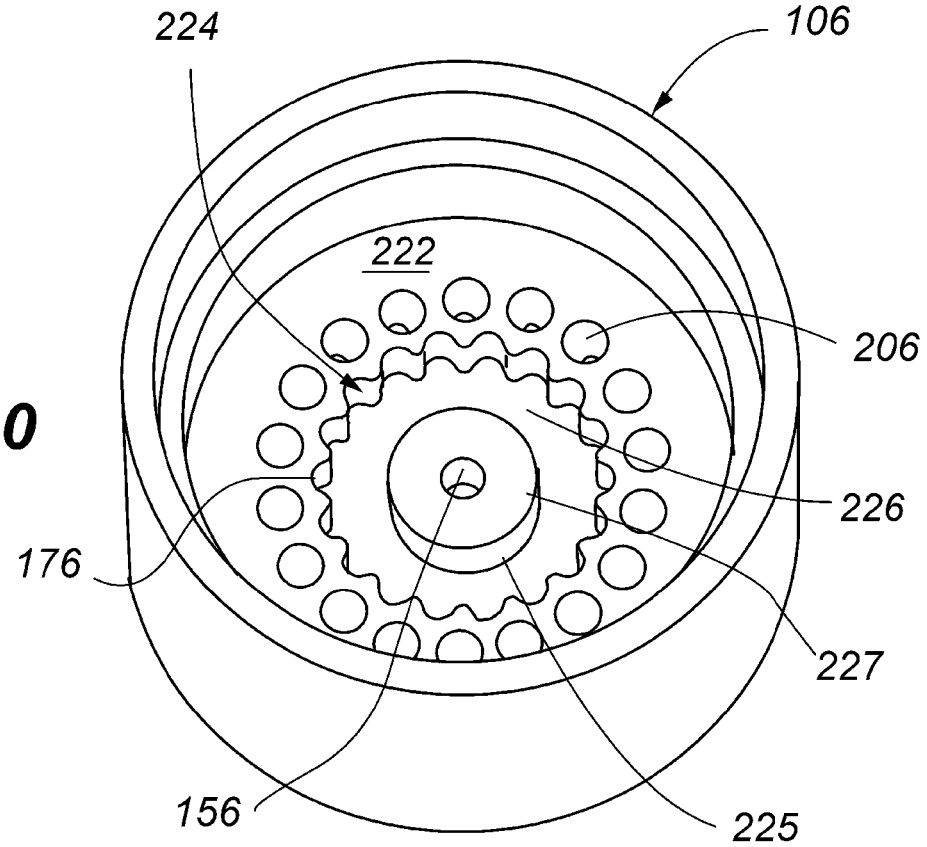
FIG. 30 depicts a top isometric view of the lower housing portion shown in FIG. 29.
Figure 31:
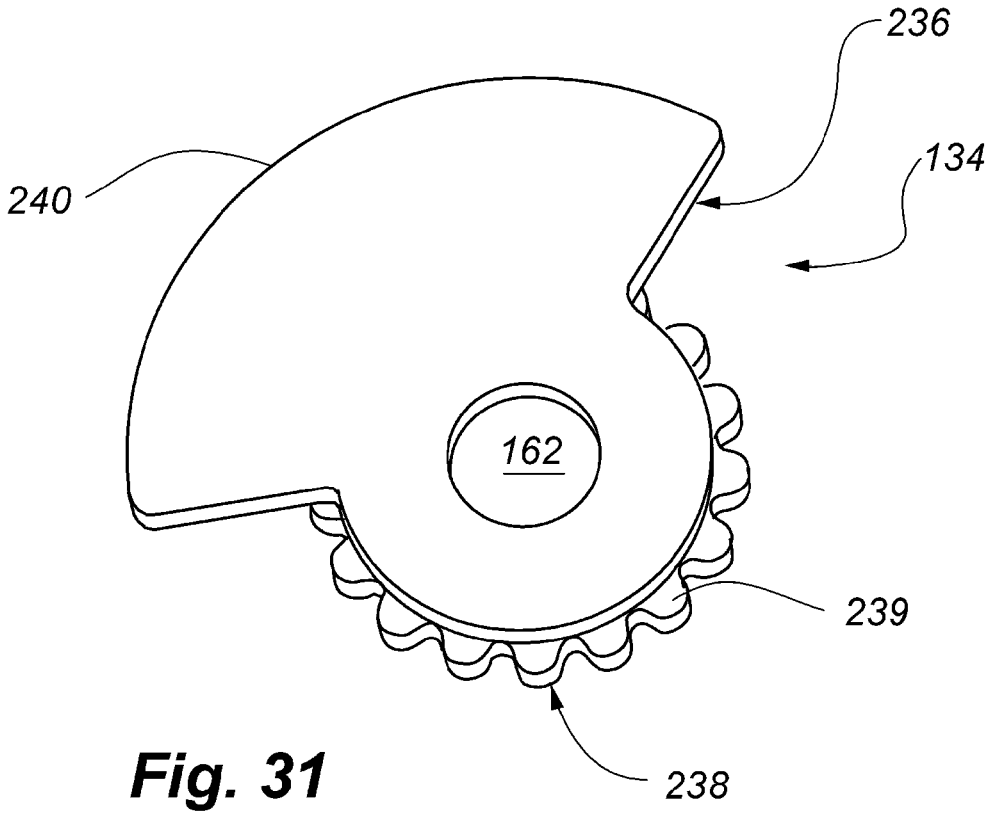
FIG. 31 depicts a top isometric view of the shutter shown in FIG. 29.
Figure 32:
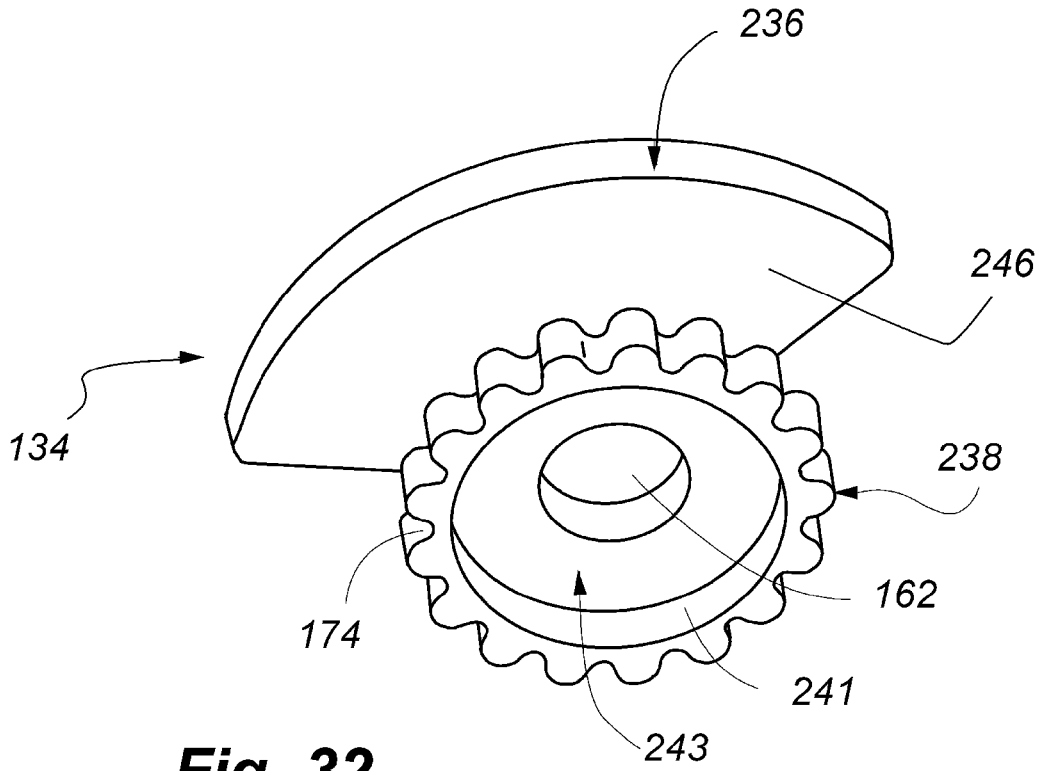
FIG. 32 depicts a bottom isometric view of the shutter shown in FIG. 29.

With particular reference to FIGS. 30-31, in accordance with the present embodiment, the shutter 134 may take the form of a multi-planar body including an upper shutter portion 236 and a lower shutter portion 238. The upper and lower shutter portions 236, 238 may be integrally formed or may be made of two separate components that are secured to one another by a suitable fastening mechanism. As with previous embodiments, the shutter 134 may include an opening 162 along its central axis to receive the eccentric cam 160. The shutter 134 may thus spin about the central axis of the eccentric cam 160 as the turbine 132 rotates. As discussed with respect to previous embodiments, the center of the eccentric cam 160 may be off-center with respect to the center axis of the turbine 132 and the lower housing 106. Thus, as the turbine 132 spins, the eccentric cam 160 moves the center of the shutter 134 in a generally eccentric circular path around the center axis of the turbine 132 and the lower housing 106. As the center of the shutter 134 moves in this generally eccentric circular path, the portion of the perimeter of the lower shutter portion 238 that engages or otherwise contacts the sidewall 224 of the annular recess 226 changes.

The upper shutter portion 236 may take the form of a generally planar body provided axially above the lower shutter portion 238 and define one or more fluid obstructing members 240. Generally, the fluid obstructing members 240 may be configured such that when shutter 134 is appropriately seated in the annular recess 226, the fluid obstructing members 240 extend over the upper surface 222 such that they substantially limit or otherwise prevent fluid flow into one or more of the fluid passage openings 206, while fluid to the remaining fluid passage openings 206 is permitted. As shown, a single fluid obstructing member 240 may be formed as a radially extended portion, which extends beyond the periphery of the lower shutter portion 238. The fluid obstructing member 240 may extend circumferentially about the upper shutter portion 236 for approximately one-third of the upper shutter portion 236. Alternatively, any number of fluid obstructing members 240 extending circumferentially for any desired portion of the shutter 134 may be employed. In further alternatives, the fluid obstructing members 240 may be shaped in any manner suitable for selectively restricting flow into one or more of the fluid passage openings 206. In further alternatives, the fluid obstructing members 240 may include one or more openings through their thickness for allowing fluid to pass therethrough.

The lower shutter portion 238 may be sized and shaped to be rotatably accommodated in the recess 226 of the lower housing portion 106. For example, as shown in FIG. 31, the lower shutter portion 238 may be formed as an annular and planar body having engagement features 174 provided on a periphery surface thereof. The engagement features 174 may, for example, be formed as gear teeth that are complementary to the engagement features 176 of the lower housing portion 106. As with previous embodiments, the number of engagement features 176 of the lower housing 106 may be more than the number of engagement features 174 of the shutter 134. The lower shutter portion 238 may further include an inner sidewall 241 that defines an annular recess 243. The annular recess 243 may be sized and shaped to be received by the pin receiving member 227 such that the shutter 134 is free to eccentrically rotate relative to the lower housing portion 106. In this regard, the annular recess 243 may have a diameter that is larger than an outer diameter of the pin receiving member 227 to accommodate eccentric movement of the shutter 134. In one embodiment, the lower shutter portion 238 may be vertically dimensioned such that when seated in the recess 226 of the lower housing 106, a top surface 239 of the lower shutter portion 238 and a bottom surface 246 of the of the upper shutter portion 236 lie in a plane substantially corresponding to the upper surface 222 of the lower housing portion 106.

In operation of the present embodiment, the flow of water through the fluid passage openings 206 may be interrupted as the obstructing member 240 passes over the fluid passage openings 206. In contrast with previous embodiments, flow of water to the fluid passage openings 206 is not achieved through defined openings in the shutter 234, but rather is achieved because the obstructing member 240 of the upper shutter portion 236 does not extend completely around the periphery of the lower shutter potion 238. When the obstructing member 240 is not over a fluid passage opening 206, water flows through the associated fluid passage 204 and exits the showerhead through the outlet 110 associated with the fluid passage 204. When a fluid passage opening 206 is aligned with the obstructing member 240, water flow ceases through the outlet 110 in fluid communication with the fluid passage opening 206. Thus, as the shutter 134 rotates, water flow through the outlets 110 may be interrupted in a sequence. This may, for example, produce a relatively low-speed, periodic interruption of water flow through each outlet 110.

As previously described above with respect to showerheads 100, 200, selective engagement of the shutter engagement features 174 with the housing engagement features 176 causes the shutter 134 to rotate at a slower speed than the turbine 132. As the shutter 134 rotates inside the lower housing 106, the obstructing member 240 may pass over one or more fluid passage openings 206 in the lower housing 106. This may permit water to temporarily flow through the unobstructed fluid passage openings 206. Thus, as the shutter 134 rotates, water flow through the outlets or nozzles 110 is periodically interrupted as the obstructing member 240 of the shutter 134 temporarily obstructs the water flow through those outlets 110 in fluid communication with fluid passage openings 206 located under obstructing member 240. This may, for example, create a pulsating flow of water from the showerhead of the present embodiment.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the invention, and do not create limitations, particularly as to the position, orientation, or use of the invention unless specifically set forth in the claims. Joinder references (e.g., attached, coupled, connected, joined and the like) are to be construed broadly and may include intermediate members between the connection of elements and relative movement between elements. As such, joinder references do not necessarily infer that two elements are directly connected and in fixed relation to each other.

In some instances, components are described by reference to "ends" having a particular characteristic and/or being connected with another part. However, those skilled in the art will recognize that the present invention is not limited to components which terminate immediately beyond their point of connection with other parts. Thus the term "end" should be broadly interpreted, in a manner that includes areas adjacent rearward, forward of or otherwise near the terminus of a particular element, link, component, part, member or the like. In methodologies directly or indirectly set forth herein, various steps and operations are described in one possible order of operation but those skilled in the art will recognize the steps and operation may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A showerhead comprising a housing defining a chamber in fluid communication with a fluid inlet and at least one fluid outlet, the housing further defining an annular recess and having a first engagement feature formed in an interior surface of the housing;

a turbine received within the chamber; and a shutter at least partially received within the annular recess of the housing, operatively associated with the turbine, and having a second engagement feature, wherein rotation of the turbine causes rotation of the shutter;

engagement of the first engagement feature with the second engagement feature causes a rotation rate of the shutter that is less than a rotation rate of the turbine; and as the shutter rotates, the shutter fluidly connects and disconnects the fluid inlet and the at least one fluid outlet.

2. The showerhead of claim 1, wherein the first engagement feature comprises a plurality of gear teeth.

3. The showerhead of claim 1, wherein the second engagement feature comprises a plurality of gear teeth.

4. The showerhead of claim 1, wherein the first engagement feature comprises a first number of gear teeth, and the second engagement feature comprises a second number of gear teeth.

5. The showerhead of claim 4, wherein the first number is greater than the second number.

6. The showerhead of claim 1, wherein the shutter comprises a substantially non-planar body including an upper shutter portion and a lower shutter portion, and wherein the upper shutter portion comprises one or more fluid obstructing members.

7. The showerhead of claim 6, wherein the fluid obstructing members comprise radially extended members which extend arcuately about the upper shutter portion.

8. The showerhead of claim 6, wherein the lower shutter portion comprises an annular member and the second engagement feature is defined in a periphery of the annular member.

9. The showerhead of claim 8, wherein the annular member is received within the annular recess of the housing.

10. The showerhead of claim 1, wherein the at least one fluid outlet comprises a plurality of fluid outlets, and the plurality of fluid outlets are disposed radially outward with respect to the first engagement feature.

11. The showerhead of claim 1, wherein the turbine and the shutter rotate in opposite directions.

12. The showerhead of claim 1, wherein the turbine and the shutter rotate in the same direction.

13. The showerhead of claim 1, wherein the rotation rate of the shutter is no greater than approximately 1/15th of the rotation rate of the turbine.

14. The showerhead of claim 1, wherein the turbine includes an eccentric cam; and the shutter includes an opening for receiving the eccentric cam.

15. The showerhead of claim 1, wherein a center of the shutter moves in a substantially eccentric path around a center of the turbine.

16. The showerhead of claim 1 further comprising a jet disk operatively associated with the turbine, the jet disk defining at least one passage extending therethrough, wherein the at least one passage is positioned with respect to the turbine such that a flow of fluid through the at least one passage effects rotation of the turbine.

17. The showerhead of claim 1, wherein the shutter comprises an annular member seated in the annular recess of the housing and the second engagement feature includes an integer number of second features distributed around a periphery of the annular member;

the first engagement feature of the housing comprises an integer number of first features incorporated within a sidewall defining the annular recess;

the number of first features is different than the number of second features; and rotation of the shutter selectively engages the first features with the second features.

18. The showerhead of claim 17, wherein the number of second features is less than the number of first features.

19. The showerhead of claim 1, wherein a portion of the shutter received within the annular recess of the housing is encompassed by the first engagement feature.

20. The showerhead of claim 19, wherein the second engagement feature extends from the portion of the shutter received within the annular recess of the housing.

21. The showerhead of claim 1, wherein the first engagement feature defines the annular recess within the housing.

22. The showerhead of claim 1, wherein the first engagement feature is disposed radially inward with respect to the at least one fluid outlet.

23. The showerhead of claim 1, wherein the interior surface forming the first engagement feature is a sidewall defining the annular recess.

24. A showerhead, comprising a housing defining a chamber in fluid communication with a fluid inlet and at least one fluid outlet, the housing defining a first engagement feature disposed radially inward with respect to the at least one fluid outlet;

a turbine received within the chamber;

a shutter received within the chamber and operatively associated with the turbine, the shutter including a second engagement feature; wherein rotation of the turbine causes rotation of the shutter;

engagement of the first engagement feature with the second engagement feature causes a rotation rate of the shutter to be less than a rotation rate of the turbine; and as the shutter rotates, the shutter fluidly connects and disconnects the fluid inlet and the at least one fluid outlet.

25. The showerhead of claim 24, wherein the turbine includes a cam; and the shutter includes an opening for receiving the cam; wherein as the turbine rotates, the cam rotates to drive rotation of the shutter.

26. A showerhead, comprising a housing defining a chamber in fluid communication with a fluid inlet and at least one fluid outlet, the housing including a first engagement feature disposed radially inward with respect to the at least one fluid outlet; and a cycloidal drive comprising a turbine received within the chamber, the turbine including an eccentric cam; and a shutter received within the chamber and operatively associated with the turbine, the shutter including a second engagement feature and an opening for receiving the eccentric cam, wherein rotation of the turbine causes rotation of the shutter; and engagement of the first engagement feature with the second engagement feature causes a rotation rate of the shutter to be less than a rotation rate of the turbine.

* * * * *